US006999705B2

(12) United States Patent
Yoshino et al.

(10) Patent No.: US 6,999,705 B2
(45) Date of Patent: Feb. 14, 2006

(54) POWDER CONTAINER, POWDER CONTAINED PRODUCT, POWDER CONTAINER MANUFACTURING METHOD, POWDER CONTAINED PRODUCT REUSING METHOD, TONER CONTAINER AND TONER CONTAINED PRODUCT

(75) Inventors: Masahiro Yoshino, Hachioji (JP); Tatsuo Nakanishi, Hachioji (JP); Yoshihiko Toyoizumi, Hachioji (JP)

(73) Assignees: Konica Corporation, (JP); Konica Minolta Business Technologies, Inc., (JP)

( * ) Notice: Subject to any disclaimer, the term of this patent is extended or adjusted under 35 U.S.C. 154(b) by 0 days.

(21) Appl. No.: 11/098,849

(22) Filed: Apr. 4, 2005

(65) Prior Publication Data

US 2005/0169674 A1 Aug. 4, 2005

Related U.S. Application Data

(63) Continuation of application No. 10/413,737, filed on Apr. 14, 2003.

(30) Foreign Application Priority Data

Apr. 19, 2002 (JP) ..... 2002-117410
Apr. 22, 2002 (JP) ..... 2002-119140
Jun. 21, 2002 (JP) ..... 2002-181390

(51) Int. Cl.
*G03G 15/08* (2006.01)

(52) U.S. Cl. ..... 399/262; 222/DIG. 1; 399/106; 399/120; 430/110.3

(58) Field of Classification Search ..... 399/262, 399/258, 120, 263, 106, 105, 103; 222/DIG. 1; 430/110.1, 110.3, 120
See application file for complete search history.

(56) References Cited

U.S. PATENT DOCUMENTS 5,627,631 A * 5/1997 Ichikawa et al. .. 222/DIG. 1 X
6,701,112 B1 * 3/2004 Kusano et al. ..... 399/262
6,731,897 B1 * 5/2004 Nagano et al. ..... 399/262
2001/0008593 A1 * 7/2001 Tsuji et al. ..... 399/262
2002/0037469 A1 * 3/2002 Kohyama et al. ..... 430/110.3

FOREIGN PATENT DOCUMENTS

JP 2000-203549 A * 7/2000

* cited by examiner

*Primary Examiner*—Sophia S. Chen
(74) *Attorney, Agent, or Firm*—Squire, Sanders & Dempsey L.L.P.

(57) ABSTRACT

A toner container for supplying and/or replenishing toner into a development apparatus of image forming apparatus, by being engaged with the rotation transfer member of the development apparatus and being rotated about a center axis of the toner container integrally with the rotation transfer member. The toner container is structured with a cylindrical body having a toner outlet on one end of the cylindrical body, nearby a center axis of the cylindrical body, a convex spiral flute formed on the inner periphery of the cylindrical body, and a concave spiral flute formed on the outer periphery of the cylindrical body, wherein a ratio L/D of length L to diameter D of the cylindrical body is in a range of $\frac{1}{2} \leqq L/D \leqq 10$, a thickness of the cylindrical body t is 0.3 mm$\leqq t \leqq$5.0 mm; and a thickness deviation of the cylindrical body is $\Delta t \leqq 20\%$.

27 Claims, 18 Drawing Sheets

TONER PARTICLE HAVING NO CORNER

TONER PARTICLE HAVING A CORNER

TONER PARTICLE HAVING A CORNER

FIG. 8 ( a )
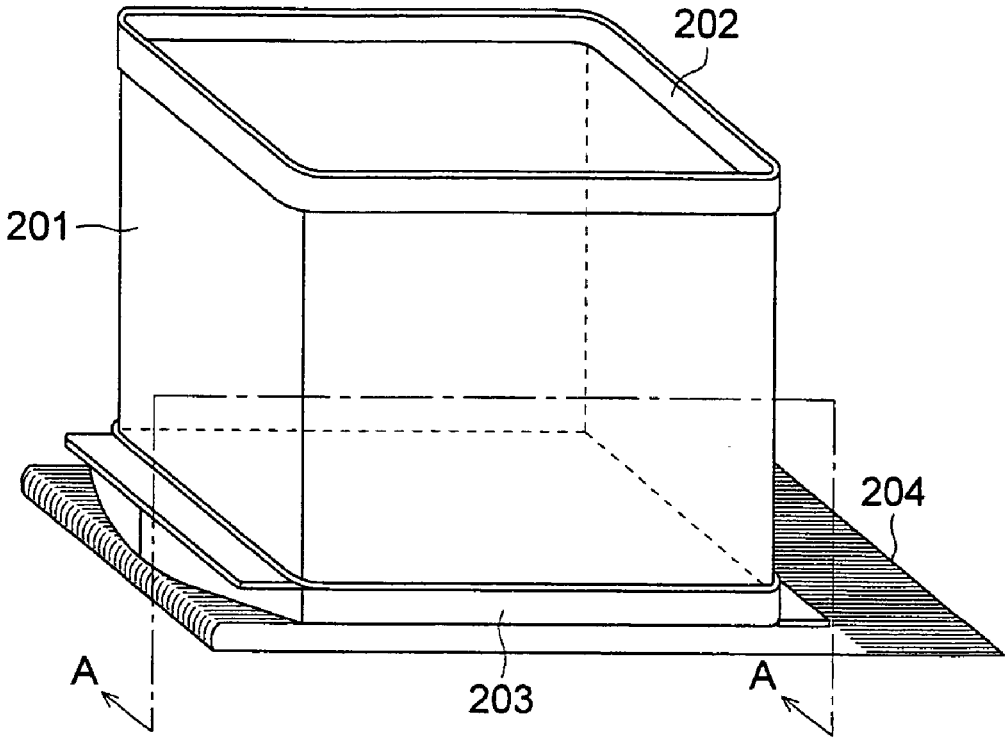
FIG. 8 ( b )
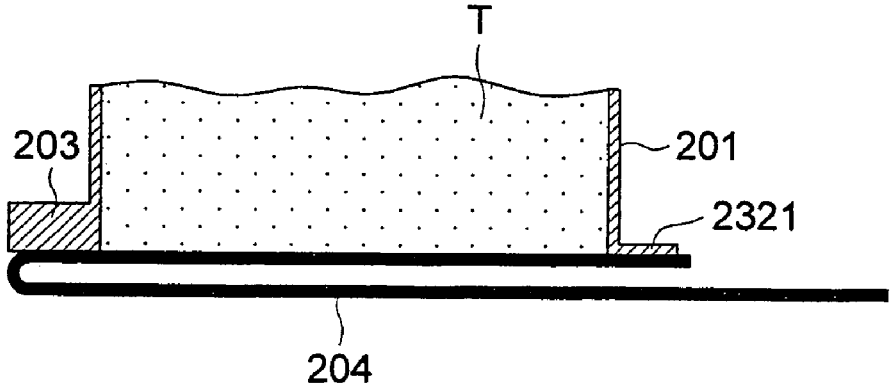

FIG. 13 ( a )
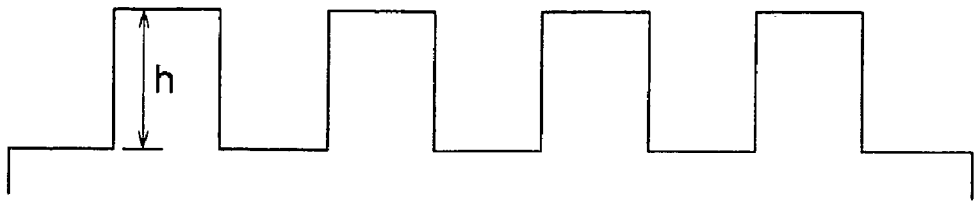
FIG. 13 ( b )
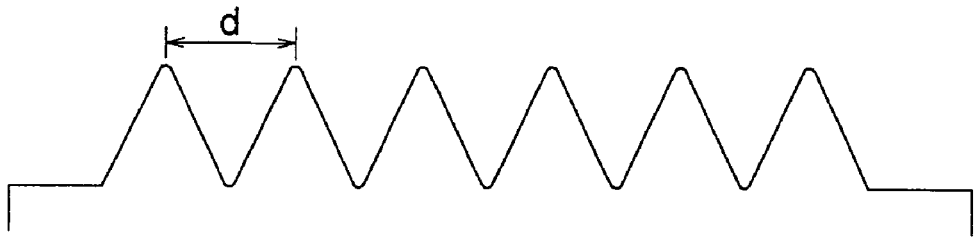
FIG. 13 ( c )
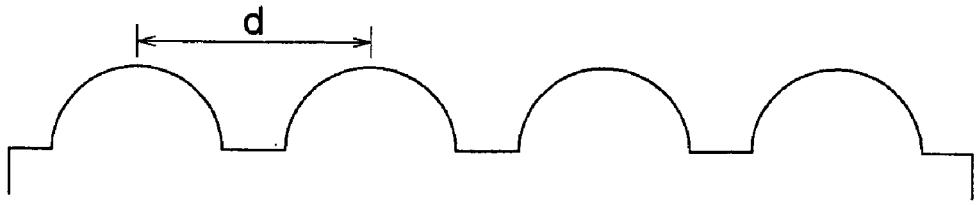
FIG. 13 ( d )
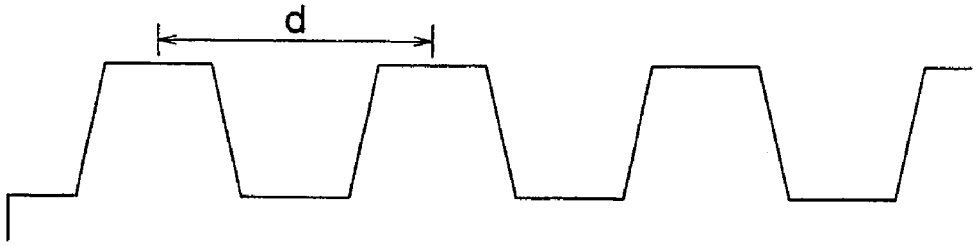

FIG. 14 ( a )
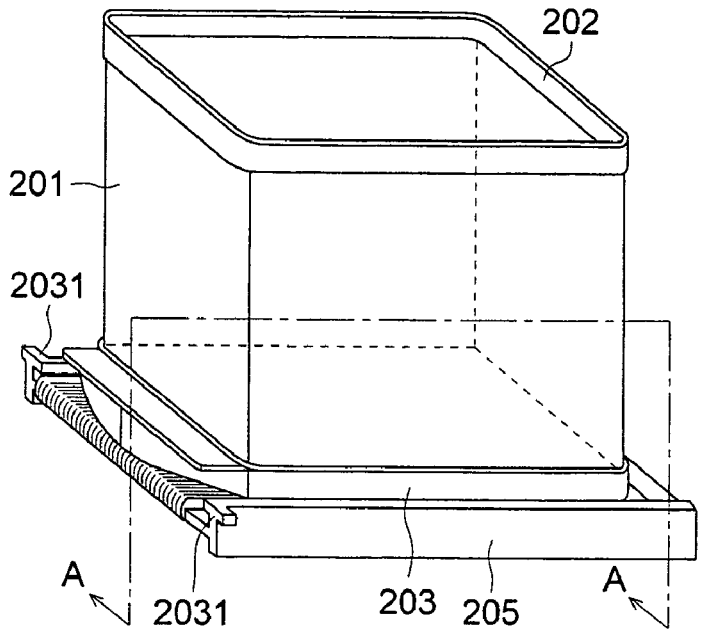
FIG. 14 ( b )
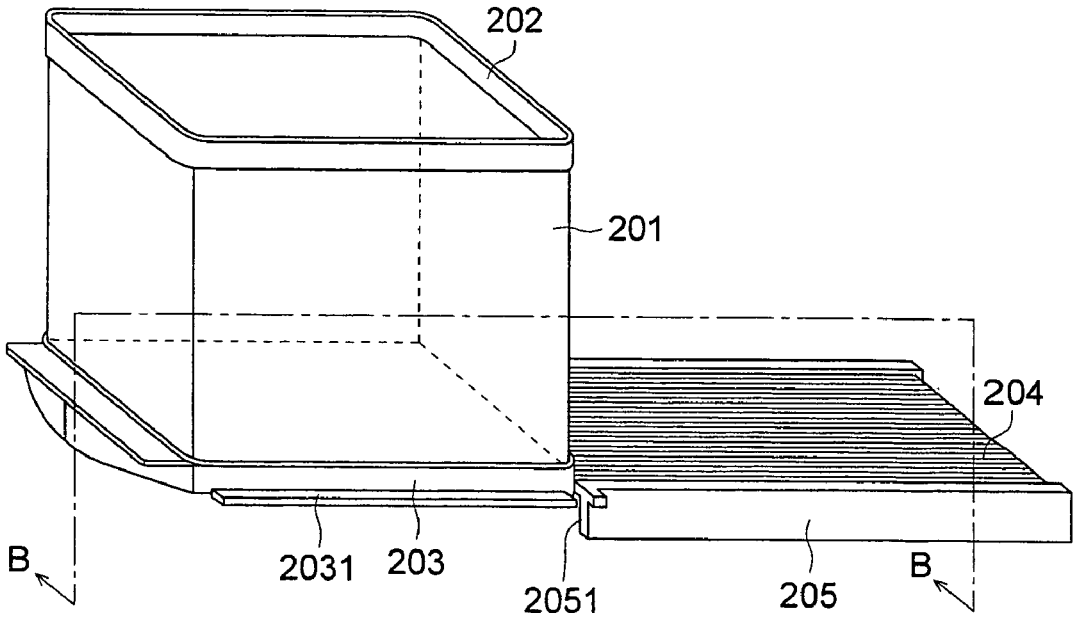

POWDER CONTAINER, POWDER CONTAINED PRODUCT, POWDER CONTAINER MANUFACTURING METHOD, POWDER CONTAINED PRODUCT REUSING METHOD, TONER CONTAINER AND TONER CONTAINED PRODUCT

RELATED U.S. APPLICATION DATA

This is a continuation of U.S. patent application Ser. No. 10/413,737, filed Apr. 14, 2003, pending.

BACKGROUND OF THE INVENTION

The present invention relates to a toner container and toner supply apparatus used for an image forming apparatus such as a copying machine and printer.

[Prior Art-1]

Such an image forming apparatus includes an apparatus wherein one end of the cylindrical toner container having a toner outlet on one end is engaged with a rotation transfer member of an development apparatus provided inside the image forming apparatus, and the toner container is rotated about the centerline of the toner container integrally linked with the rotation transfer member, whereby toner in the toner container is discharged from the toner outlet and is supplied to the development apparatus.

[Problems to be Solved by the Invention-1]

A toner container and toner supply apparatus used in an image forming apparatus for electrophotography are required to meet the high speed of the image forming apparatus. In other words, it is necessary to increase the capacity of the toner container to meet the increasing speed and to ensure an uninterrupted supply of toner from the toner container to the development apparatus. Especially, when there is a shortage of toner remaining inside the toner container, the toner remaining at the bottom of the toner container must be smoothly fed into the development apparatus and the older toner container replace it with a new one.

The present invention has been made to meet the aforementioned requirements, and is intended to provide a toner container and toner supply apparatus that ensure an uninterrupted supply of toner to the development apparatus, despite the shortage of toner remaining in the toner container, to meet the increasing speed of the image forming apparatus.

Further, the present invention relates to a powder container and a powder contained product that are mounted on an apparatus to which powder is supplied. More particularly, it relates to a powder container and a powder contained product that are designed in such a way that the opening of the container is shielded by a film-like sealing material and repeated use is permitted, as well as to a toner container that is mounted on the electrophotographic image forming apparatus including a camera to supply toner, and a toner contained product consisting of this container filled with toner.

[Prior Art-2]

Compared to a container where a cover is used to enclose the opening, the powder container where a sealing material is bonded to the opening of a container to enclose the container provides less costly simplification of the opening structure and ensures a high degree of hermeticity, and is therefore used over an extensive range in the powder related fields. For example, when it is used as a toner contained product used in an electrophotographic image forming apparatus, the product is mounted on an apparatus with the product stored in a container, and the seal is separated to supply toner. This arrangement prevents contamination due to spread of toner, and ensures a high degree of hermeticity during storage period. This makes it possible to maintain long-term product quality.

The powder container with the opening shielded with a sealing material is required to ensure an effective separation of a film-like sealing material from the container opening at the time of separation. The Official Gazette of Japanese Application Patent Laid-Open Publication No. Sho 1983-224364 discloses a powder container where a loop-shaped film-like sealing material is used as a tractive member for separation from the container opening. The Official Gazette of Japanese Application Patent Laid-Open Publication No. Hei 01-280781 discloses a technique of sealing toner into a container as a powder product.

Further, the Official Gazette of Japanese Application Patent Laid-Open Publication No. Hei 10-104922 discloses a toner supply container wherein a sealing material tractive member called slide cover is provided with embossing to accelerate separation from the sealing compound. Here friction coefficient between the sealing material and sealing tractive member is reduced to ensure smooth separation of the sealing compound, without requiring much force.

In recent years, attention has been given to reuse of resources from the viewpoint of cost reduction and environmental protection. In the field of powder containers, a framework of physical distribution is being established to collect and recover the used containers, which are refilled with powder and are shipped for distribution. Such a reusable container is required to provide a high degree of durability to allow repeated use. However, in the toner supply container disclosed in the aforementioned the Official Gazette of Japanese Application Patent Laid-Open Publication No. Hei 10-104922, the slide cover is provided with embossing treatment, and reuse of such a container has been found out to be difficult. In other words, the embossed surface where the sealing material has been deposited is roughened, and the bonding strength permitting the reuse of a product cannot be obtained even if the sealing material is deposited.

To solve this problem, attempts were made to process the embossed surface or to set the sealing material deposition temperature at a higher level at the time of reuse to bond the seal in position. However, processing of the embossed surface was to add a process that took much time in preparing for reuse. Further, setting the deposition temperature to a higher level increased the energy consumption and raised the environmental load and processing costs. These measures have failed to achieve the object of cutting down the cost and environmental load by reuse of the container. Further, if the sealing material is bonded at a higher deposition temperature, variations occur in the deposition strength for each container, and it has become difficult to ensure handling quality including smooth separation.

It has been found out that a method for reuse by replacement of an older slide cover with a new one is economically viable. However, there has been much to be improved in the method for reuse through replacement of component parts of the container with new ones.

Studies have been made to find out ways of cost cutting and energy saving by reducing the number of container components. The method of using special-purpose sealing material separation parts and applying uniform load to the sealing material deposited on the container body has been a sure way of separating the sealing material deposited on the container body with a certain amount of strength maintained, without damaging it. For this reason, a slide cover has been an essential component of a powder container.

As described above, when implementing the plan for reuse of the powder contained product comprising a container with its opening enclosed with a film-like sealing compound, many problems have been yet to be solved for effective implementation of a reuse program with consideration given to economical viability and environmental protection.

[Problems to be Solved by the Invention-2]

The present invention has been mode to solve the aforementioned problems.

One of the objects of the present invention is to provide a powder container and a powder contained product using a film-like sealing material that ensures stable, long-term separability and hermeticity, despite measures taken for reuse, namely, despite repeated sealing of the opening with a film-like sealing material by refilling of a used container with powder.

A second object of the present invention is to provide a powder container and a powder contained product characterized in that the aforementioned powder container uses a film-like sealing compound, and the aforementioned powder container and powder contained product ensure easy and reliable separation of sealing material by reduced number of parts from the prior art level, even without using sealing material separation member.

A third object of the present invention is to provide a powder contained product that ensures stable, long-term maintenance of the quality of powder stored in the container, without powder leaking out of the space between sealing material and container, despite repeated filling of a used container with powder and repeated sealing with a sealing compound.

A fourth object of the present invention is to provide a powder container manufacturing method characterized in that;

in a powder container and powder contained product that use film-like sealing material to seal the opening, the aforementioned powder container manufacturing method uses a reusable film-like sealing material immune to deterioration of deposition strength and separability at contact positions between the container body and sealing compound, despite measures taken to reuse the used container.

A fifth object of the present invention is to provide a toner container and toner contained product capable of maintaining stable, long-term separability and hermeticity, despite refilling of a used container with electrostatic image development toner and repeated sealing of the opening with film-like sealing compound.

The present invention further relates to a powder container and a powder contained product, particularly to a powder container and a powder contained product that are best suited to reuse, being strong but easily dismountable, and to a toner container and toner contained product where powder is electrostatic image development toner.

[Prior Art-3]

In recent years, a physical distribution framework has been established. A used powder container is collected by a manufacturer, and the collected container is refilled with powder to be shipped for distribution. To meet the requirements for reuse, most of the container body and its container component members are being made of materials immune to deformation and damage despite repeated usage.

Similar to a cartridge disclosed in the Official Gazette of Japanese Application Patent Laid-Open Publication No. Hei 06-208301, in order to ensure reliable and effective supply of powder to an apparatus and to standardize the parts for a great variety of products, some of powder containers are made of multiple members mounted on the container body, wherein the installation position on the apparatus and component members such as powder supply section are provided separately from the container body. The container of such an arrangement is designed with consideration given to the strength and hermeticity of engagement portions in order to ensure that there is sufficient mechanical strength in parts engagement portions or fitting portions without any leakage of powder from engagement portions. This arrangement results in difficulties in removing engagement portions.

When a manufacturer refills a container with powder, it is sometimes necessary to refill powder after going through a process of cleaning the container body and its component members to ensure that previous powder will not remain inside. This is found in a great number of fields, e.g. in the field of edible powder placed under severe sanitary control including a soybean flour supply cartridge for an automatic rice cake manufacturing apparatus and a powder supply cartridge for an automatic Japanese pancake manufacturing apparatus, and in the field of electrophotographic toner cartridge where beautiful toner image quality is required.

In such fields, quick and reliable disengagement of parts is essential. At present, however, it is difficult to find out a container where disengagement of parts is easy, under the pretext of meeting the requirements for process reduction achieved by creating a rigid fitting at the time of manufacture and the requirements for cost reduction. Further, undue force must be applied to these containers at the time of disengagement of parts, so deterioration will develop due to the load locally applied to the member at the time of disengagement, and constituent members are damaged. Such problems have occurred so far. Reuse of the container is hindered by the damage of the constituent members resulting from the load applied to the members at the time of disengagement.

In some cases, a container is manufactured, for example, through a process of bonding of sealing material to the container opening, with an engagement member locked temporarily on the container body. In such a container manufacturing method, it is preferred that work should be carried out, with temporarily locked engagement members fixed immovable. However, when a tool is used to grip the container body, the container body may be damaged, or deteriorated due to fatigue. To prevent this, a special tool must be custom-designed. It has been not possible to manufacture such a container economically without such investment, according to the prior art.

[Problems to be Solved by the Invention-3]

The present invention has been made to solve the aforementioned problems. To be more specific, the object of the present invention is to provide a powder container and a powder contained product consisting of this powder container filled with powder, wherein the aforementioned powder container comprising multiple members engaged together can be easily disassembled to allow for reuse.

A second object of the present invention is to provide a powder container manufacturing method characterized in that temporary locking of engagement members on the container body is provided without preparing a special tool or jig, and separate work such as bonding of sealing material on the opening can be performed easily at reduced costs.

A third object of the present invention is to provide a powder contained product reusing method characterized in that, when a great number of used powder containers have been collected from the market, these containers can be easily dismounted and cleaned by manufacturers.

A fourth object of the present invention is to provide an easily dismountable and reusable electrostatic image development toner container, and an electrostatic image development toner contained product consisting of this toner storage container filled with toner; wherein the electrostatic image development toner container consists of multiple members engaged together.

SUMMARY OF THE INVENTION

[Means for Solving the Problems-1]

To solve the aforementioned problems and to achieve the objects, the present invention has been arranged as follows:

(1) A cylindrical toner container engaged with the rotation transfer member of a development apparatus arranged in an image forming apparatus and rotated about the centerline integrally with the rotation transfer member whereby toner is supplied or replenished to the aforementioned development apparatus;

this toner container further characterized in that a toner outlet is arranged close to the cylindrical centerline on one end;

a convex spiral flute is arranged on the inner periphery of this cylindrical form and a concave spiral flute on the outer periphery;

the ratio L/D of cylinder length L to cylinder diameter D is $\frac{1}{2} \leqq L/D \leqq 10$;

a cylinder thickness t is 0.3 mm$\leqq t \leqq$5.0 mm; and a cylinder thickness deviation is $\Delta t \leqq 20\%$.

According to the invention given in (1), a cylinder thickness t is 0.3 mm$\leqq t \leqq$5.0 mm and a cylinder thickness deviation is $\Delta t \leqq 20\%$. This arrangement ensures that the convex spiral flute on the inner periphery of this cylindrical form and concave spiral flute on the outer periphery are not crushed, and drastically improves the transportability of toner inside the toner container, thereby ensuring a smooth supply of toner into the development apparatus even when there is only a small amount of toner in the toner container.

(2) A toner replenishing apparatus wherein one end of the cylindrical toner container having a toner outlet on one end is engaged with a rotation transfer member of an development apparatus provided inside an image forming apparatus, and the toner container is rotated about the centerline of the toner container integrally with the rotation transfer member, whereby toner in the toner container is discharged from the toner outlet and is supplied to the development apparatus;

this toner replenishing apparatus further characterized in that a toner outlet is arranged close to the cylindrical centerline on one end;

a convex spiral flute is arranged on the inner periphery of this cylindrical form and a concave spiral flute on the outer periphery;

the ratio L/D of cylinder length L to cylinder diameter D is $\frac{1}{2} \leqq L/D \leqq 10$;

a cylinder thickness t is 0.3 mm$\leqq t \leqq$5.0 mm; and a cylinder thickness deviation is $\Delta t \leqq 20\%$.

According to the invention given in (2), a cylinder thickness t is 0.3 mm$\leqq t \leqq$5.0 mm and a cylinder thickness deviation is $\Delta t \leqq 20\%$. This arrangement ensures that the convex spiral flute on the inner periphery of this cylindrical form and concave spiral flute on the outer periphery are not crushed, and drastically improves the transportability of toner inside the toner container, thereby ensuring a smooth supply of toner into the development apparatus even when there is only a small mount of toner in the toner container.

[Means for Solving the Problems-2]

In order to solve the aforementioned problems, the present inventors have made a strenuous effort and have found out the powder container characterized as follows: When multiple projections provided with some regularity are arranged at a position of the container in contact with the film-like sealing material (hereinafter also called "sealing member") and film-like sealing material is deposited with multiple projections laid out, then powder having a sufficient strength can be maintained in a stable state for a long time, and the sealing material can be easily separated by gently pulling with hand. They have found out a reusable powder container characterized in that sufficient hermeticity can be maintained during storage period, despite repeated deposition of the film-like sealing material, and the sealing material can be easily separated by gently pulling with hand.

Especially in this invention, the present inventors have found out a powder container and powder contained product characterized as follows: When the shape, height, layout spacing, density and cross section of the projections arranged at a position of the container in contact with the sealing material are specified so that these projections have regularity; thus, projections and depressions are provided at the position of the container body in contact with the sealing material, then the sealing material is firmly bonded to the container body and the bonded state can be maintained for a long time. Further, this arrangement allows easy and reliable separation of the sealing material by gentle pulling by hand.

In the present invention, it has been made clear that the aforementioned effect is provided when projections and depressions are arranged on the contact surfaces between the sealing material and container body. In the prior art, it was considered that a smooth surface maintained at the contact position between the sealing material and container body contributed to effective bonding characteristics and reliable separation. In this sense, the present invention completely overthrows the traditional technological concept that smoothness at the contact position is essential to ensuring excellent bonding properties and reliable separability.

As described above, the present invention has the novelty that cannot possibly be considered from the prior art, and can be realized by one of the following arrangements:

(201) A powder container comprising a container body having an opening for discharging powder and a sealing member for sealing the aforementioned opening, wherein the surface of the container body is provided with multiple projections having regularities at the portion in contact with the sealing member.

According to the invention described in (201), the present inventors have found out a powder container characterized as follows: When multiple projections having regularities are arranged at least around the opening of the container, it is possible to ensure stable and long-term hermeticity during storage period despite repeated reuse, and to permit easy separation of sealing material by pulling with hand.

(202) A powder container according to (201) characterized in that a separation member is provided to separate from the opening the sealing member that seals the opening.

The invention described in (202) has provided a powder container characterized in that, when a separation member for separating the sealing material is arranged, easy and reliable separation can be achieved with almost no load on the sealing material, and reuse of the sealing material is permitted since no load is imposed on the sealing material.

(203) A powder container described in (201) or (202) characterized in that the aforementioned multiple projections are laid out in an island structure.

(204) A powder container described in (201) or (202) characterized in that the aforementioned multiple projections are laid out in a network structure.

(205) A powder container according to any one of items (201) through (204) characterized in that the height of the projection is 30 μm and over up to and including 300 μm.

(206) A powder container according to any one of items (201) through (205) characterized in that the height of the projection is 10% and over up to and including 70% the thickness of the sealing member.

(207) A powder container according to any one of items (201) through (206) characterized in that the projection are laid out with an interval of 10 μm and over up to and including 500 μm.

(208) A powder container according to any one of claims 1 through 7 characterized in that the density of the projection is 10 projections per square millimeter and over up to and including 1,000 projections per square millimeter.

(209) A powder container according to any one of items (201) through (208) characterized in that the cross section of the projection is rectangular.

(210) A powder container according to any one of items (201) through (208) characterized in that the cross section of the projection is triangular.

(211) A powder container according to any one of items (201) through (207) characterized in that the cross section of the projection is semicircular.

(212) A powder container according to (209) characterized in that the cross section of the projection is trapezoidal.

The invention described in (203) through (212) provides a powder container characterized in that, when the layout, shape, height, layout spacing, density, cross section and other conditions of the projections are specified, the effects described in (201) and (202) are obtained; wherein, furthermore, this powder container is reusable since there is no reduction in deposition strength or separability at the contact position between the container body and sealing material, despite repeated sealing of film-like sealing material on the container body.

(213) A powder container according to any one of items (201) through (212) characterized in that the position having the aforementioned projections constitutes a heat sealed surface.

The invention described in (213) has been made clear that strong bonding property and quick and reliable separation of the sealing material can be ensured when the multiple projections consisting of convex and concave forms are arranged on the contact position between the container body and sealing material and a heat seal surface is formed. Thus, this invention has completely overthrown the conventional concept in the prior art that the heat seal surface should be maximally smooth.

(214) A powder contained product with powder contained in the powder container according to any one of items (201) through (213).

The invention described in (214) provides a powder contained product characterized in that, when powder is stored into a powder container with multiple projections having regularities formed at the position of the container body in contact with the sealing material, the powder filled therein does not leak out of a clearance between the sealing material and container, and is not affected by external environmental conditions. This arrangement ensures the stable powder quality to be maintained for a long time. Furthermore, when the sealing material is separated, it can be separated in an easy and reliable manner by pulling with hand, without being damaged. The invention described in claim 14 also provides a reusable powder contained product characterized in that, if the used container is collected and recovered for reuse, the deposition strength and separability between the container body and sealing material are not affected.

(215) A powder container manufacturing method wherein sealing is provided by depositing sealing member on the opening of the container body having this opening for discharging powder, this powder container manufacturing method further characterized in that multiple projections having regularities are arranged around the opening of the container body, and the tips of these multiple projections are brought in contact with sealing member to perform deposition.

(216) A powder container manufacturing method wherein sealing is provided by depositing sealing member on the opening of the container body having this opening for discharging powder, this powder container manufacturing method further characterized in that a die used for molding this container body is equipped with projections and depressions by at least any one of etching, sandblasting and electro-discharge machining, and this die is used to manufacture the aforementioned container body.

The invention described in (215) and (216) provides a powder container manufacturing method that ensures the stable powder quality to be maintained for a long time, without the powder filled inside leaking out or being affected by external environmental conditions. This method also allows the sealing material to be separated in an easy and reliable manner by pulling with hand. This invention further provides a reusable powder container manufacturing method characterized in that deposition strength and separability at the contact positions are not affected when the powder contained product with the opening sealed with the film-like sealing material has been reused and bonding of sealing material to the container body has been repeated.

(217) An electrostatic image development toner container characterized in that the powder container according to any one of (201) through (213) is a container for storing electrostatic image development toner.

(218) An electrostatic image development toner contained product comprising an electrostatic image development toner container of (217) filled with electrostatic image development toner.

The invention described in (217) and (218) provides a reusable toner container and a toner contained product characterized by stable, long-term separability and hermeticity maintained despite repeated refilling of the used container with electrostatic image development toner and repeated sealing of the opening with film-like sealing material.

(219) An electrostatic image development toner container manufacturing method wherein sealing is provided by depositing sealing member on the opening of the container body having this opening for discharging electrostatic image development toner; this electrostatic image development toner container manufacturing method further characterized in that multiple projections having regularities are arranged around the opening of the container body, and the tips of these multiple projections are brought in contact with sealing member to perform deposition.

(220) An electrostatic image development toner container manufacturing method wherein sealing is provided by depositing sealing member on the opening of the container body having this opening for discharging electrostatic image development toner; this electrostatic image development toner container manufacturing method further characterized in that a die used for molding this container body is equipped with projections and depressions by at least any one of etching, sandblasting and electro-discharge machining, and this die is used to manufacture the aforementioned container body.

The invention described in (219) and (220) provides a reusable toner container manufacturing method characterized in that stable, long-term separability and hermeticity can be maintained despite repeated refilling of the used container with electrostatic image development toner and repeated sealing of the opening with film-like sheet-formed material.

It should be noted that the container body of the powder container and electrostatic image development toner container according to the present invention consists of a rigid container made up of plastics and is equipped with an opening for discharging stored powder from the site where powder is stored and maintained.

It should be noted that the sealing member according to the present invention is made of plastic film-like sheet-formed material. It is flexible and has a certain degree of tensile strength. The surface in contact with the container body forms a surface consisting of an adhesive material. This arrangement allows the opening of the container body to be sealed, and ensures the powder in the container to be sealed. At the same time, it provides easy and reliable separation from the opening.

[Means for Solving the Problems-3]

In order to solve the aforementioned problems, the present inventors have made a strenuous effort and have found out these problems can be solved by the art described in any one of the following arrangements.

(301) A powder container comprising a container body having an opening for discharging powder stored therein, and an engagement member for engagement with the container body; wherein the powder container comprises a locking member for locking and keeping the engagement member engaged integrally with the container body, and this locking member comprises multiple holding means for allowing the locking member to held by the engagement member or container body.

(302) A powder container described in (301) characterized in that a locking member holding means for holding the locking member is provided on the container body or on the engagement member.

(303) A powder container described in (301) or (302) characterized in that the locking member comprises energizing means, which is energized to allow holding means of the locking member to be held by the container body or engagement member in such a way that the container body and engagement member are held integral with each other.

(304) A powder container described in (303) characterized in that the energizing means of the locking member is a configurational notch of the locking member.

(305) A powder container described in any one of items (301) through (304) characterized in that the locking member and engagement member are made of the same material as the container body.

The invention described in any one of items (301) through (305) provides a reusable powder container comprising of multiple members engaged with each other. This powder container is characterized by easy disassembling.

The art described in (303) and (304) ensures that the engagement of the engagement member with the container body is made firmer and more rigid by the locking member by a locking member provided with energizing means. Furthermore, when the holding means of the engagement member side consists of a hole, this art ensures easy removal of the locking member when deenergized using a ball-point pen placed into this hole.

The art described in (305) provides an environment friendly powder container characterized in that the components of the powder container made of the same material not only reduce manufacturing costs, but also allow all parts to be recycled as component materials for a new container without being scrapped when the product itself need not be reused as a result of engineering change or others.

(306) A powder contained product comprising the powder container described in any one of (301) through (305) filled with powder.

The art described in (306) provides a powder contained product comprising a powder container filled with powder, wherein this powder container consists of multiple reusable and easy-to-disassemble members.

(307) A powder container manufacturing method wherein a plate-formed locking member is used to engage an engagement member with the container body having an opening for discharging powder stored inside so that the engagement member is integrated with the container body. This powder container manufacturing method is further characterized in that the locking member is held by either the engagement member or container body to ensure that the engagement member and container body are integrated with each other.

The art described in (307) provides a powder container manufacturing method wherein the engagement member is temporarily locked onto the container body without any special tool or jig, and such separate work as bonding of sealing material to the opening can be performed in an easy and economical manner.

(308) A method of reusing a powder contained product described in (306) comprising:

a step of collecting the used powder contained product described, a step of disassembling the powder container of the powder contained product into parts, a step of washing and drying the disassembled parts, a step of assembling to form the powder container, a step of refilling this container with powder to supply the powder contained product.

The art described in (308) provides a powder contained product reusing method for simplifying the disassembling and washing work by a manufacturer when a great number of used powder containers have been collected from the market.

(309) A powder container described in any one of (301) through (305), characterized in that powder contained in the powder container is electrostatic image development toner.

(310) A toner contained product characterized in that the toner container described in (309) is filled with electrostatic image development toner.

(311) A toner container manufacturing method characterized in that the powder container manufactured according to the powder container manufacturing method described in (307) is a toner container.

(312) The powder contained product reusing method described in (308) characterized in that powder contained product reusing method is an electrostatic image development toner contained product reusing method.

The art described in (309) through (312) provides:

an easily dismountable and reusable electrostatic image development toner container, an electrostatic image development toner contained product consisting of this toner storage container filled with toner, a method for manufacturing this container, and a method for reusing the toner contained product;

wherein the electrostatic image development toner container consists of multiple members engaged with each other.

The powder contained product according to the present invention is characterized in that, when powder stored in the container is supplied to the apparatus, the container together with powder is mounted on the apparatus and power is supplied thereto.

The container body according to the present invention is a constituent part filled with powder and storing it.

The engagement member according to the present invention is a component inherently independent of the container body, but is engaged integrally with the container body through the locking member to be described later. The foregoing description is based on the assumption that only one engagement member is linked with the container body in the present invention, but should not be considered to be restricted to the number of the engagement members; any number will be acceptable in the present invention if it is one or more.

The locking member used in the present invention is a member used for connection between the engagement member and container body, without being limited thereto. Any alternative can be used if it connects between the engagement member and container body. To put it more specifically, it can be a plate-formed or pin-formed member. It is preferred to be a plate-formed member or more preferred to be a curved plate-formed member.

Similarly to the container body and engagement member, the locking member in the present invention is suited for reuse, because it is highly resistant to contamination by powder. Should it be contaminated, contamination can be easily removed.

BRIEF DESCRIPTION OF THE DRAWINGS

FIGS. 8(*a*) and (*b*) are a perspective view of the powder container with its opening sealed by a film-like sealing material and a cross sectional view showing the opening;

FIGS. 13(*a*) to (*d*) are schematic diagrams representing various sectional views of multiple projections;

FIGS. 14(*a*) and (*b*) are perspective views representing the powder container having sealing material traction member (slide cover);

DETAILED DESCRIPTION OF THE PREFERRED EMBODIMENT

This document fully incorporates by reference the entire contents of U.S. patent application Ser. No. 10/413,737, filed Apr. 14, 2003.

[Description of the Preferred Embodiment-1]

Referring to drawings, the following describes the embodiments of a toner container and toner supply apparatus according to the present invention, without the present invention being restricted thereto.

Figure 1:
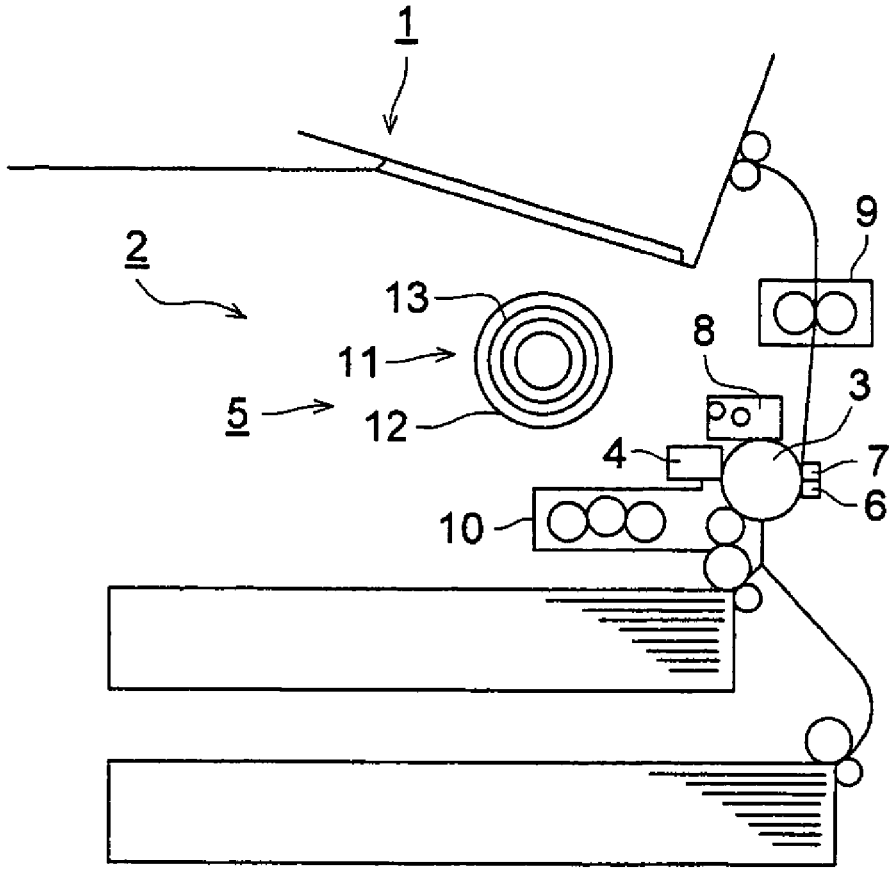
FIG. 1 is a drawing representing the overall structure of a plain paper copying machine as an image forming apparatus.

FIG. 1 is a front view of the vertical cross section schematically representing the overall structure of a plain paper copying machine 1 as an image forming apparatus. A drum-shaped photoconductor 3 is installed approximately at the center of the case 2 of the plain paper copying machine 1. An electrostatic charging and exposure apparatus 4, a development apparatus 5, a transfer unit 6, a separator 7, a cleaning apparatus 8 and a fixing device 9 are arranged around this photoconductor 3. The development apparatus 5 comprises a development unit 10 and a toner supply apparatus 11.

Figure 2:
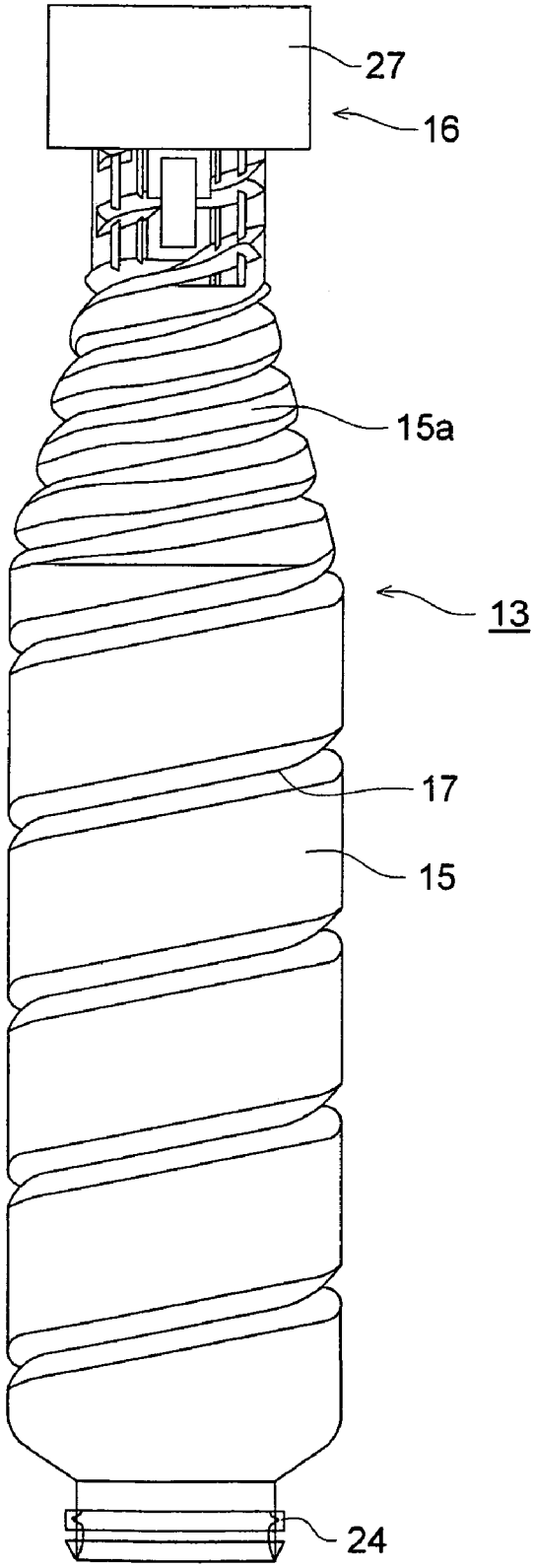
FIG. 2 is an external view of the toner container.
Figure 3:
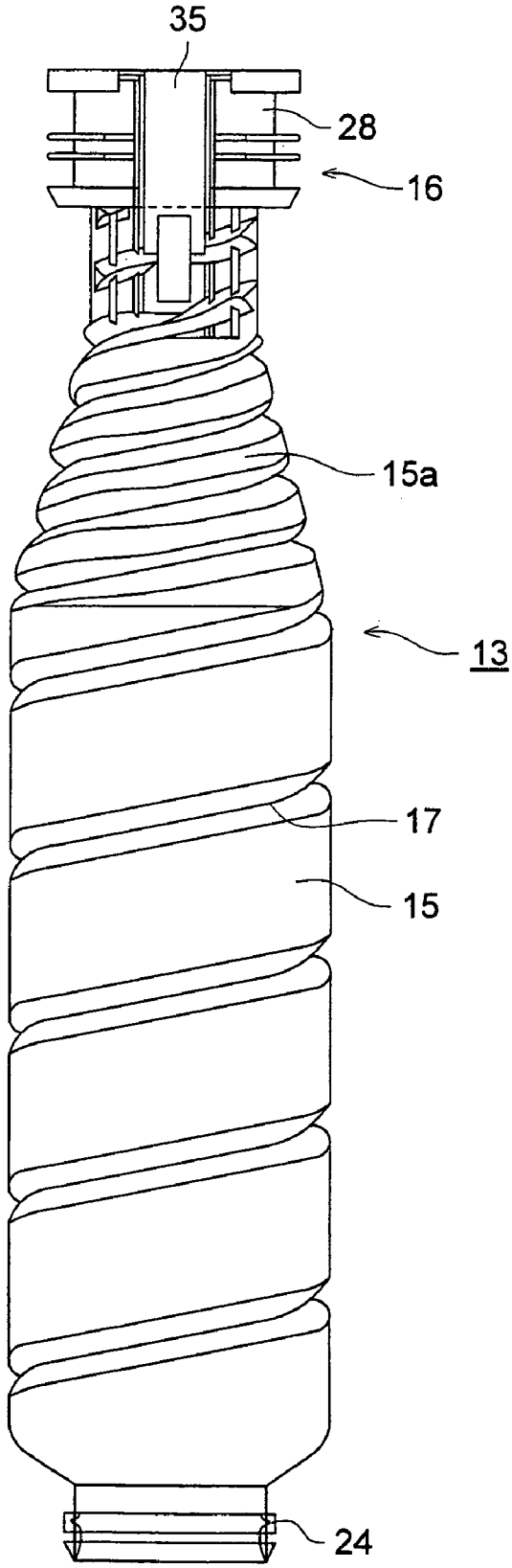
FIG. 3 is an external view of the toner supply port of a toner container with cap removed.
Figure 4:
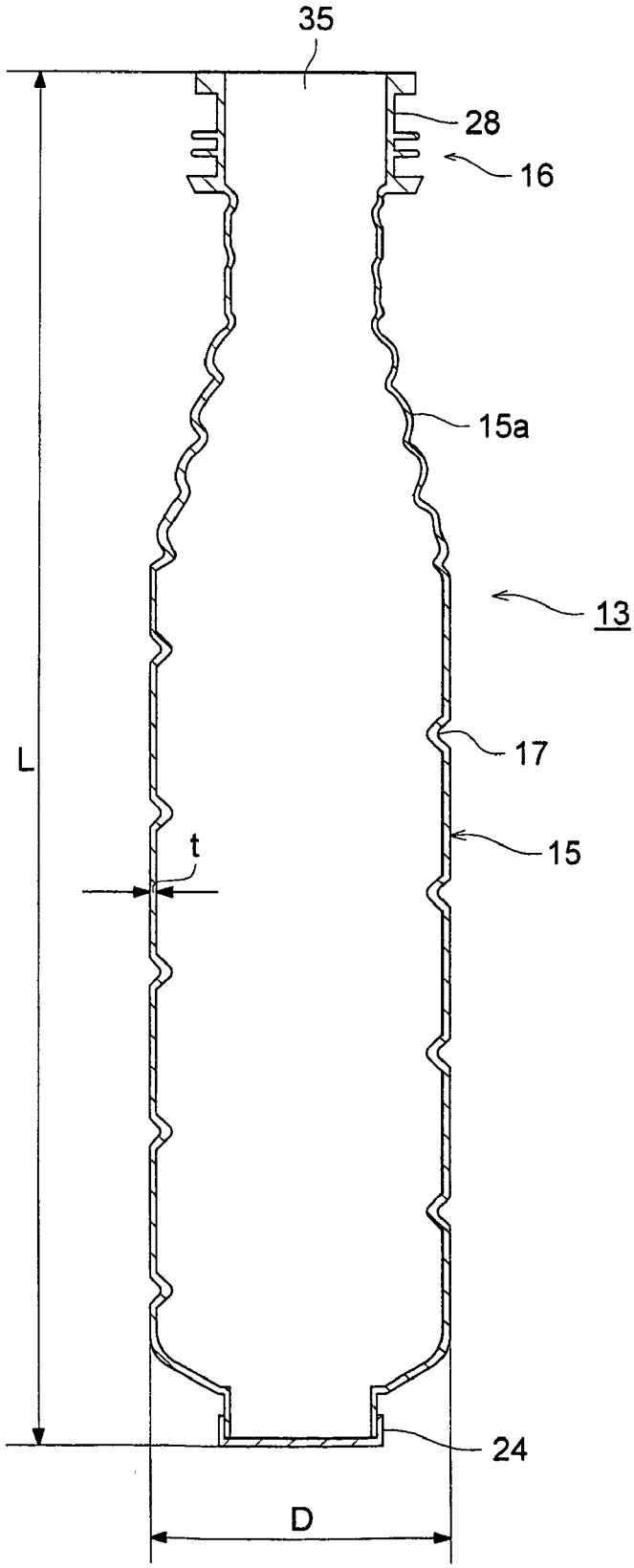
FIG. 4 is a cross sectional view of the toner supply port of a toner container with cap removed.
Figure 5:
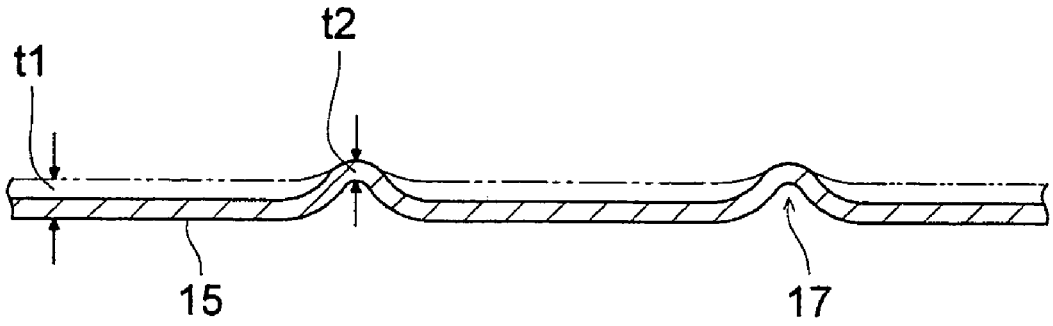
FIGS. 5(*a*) and (*b*) are enlarged cross sectional views representing part of the toner container.
Figure 5:
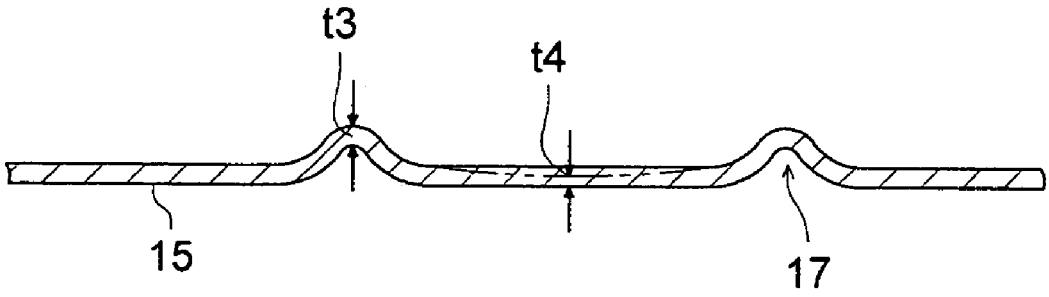
Figure 6:
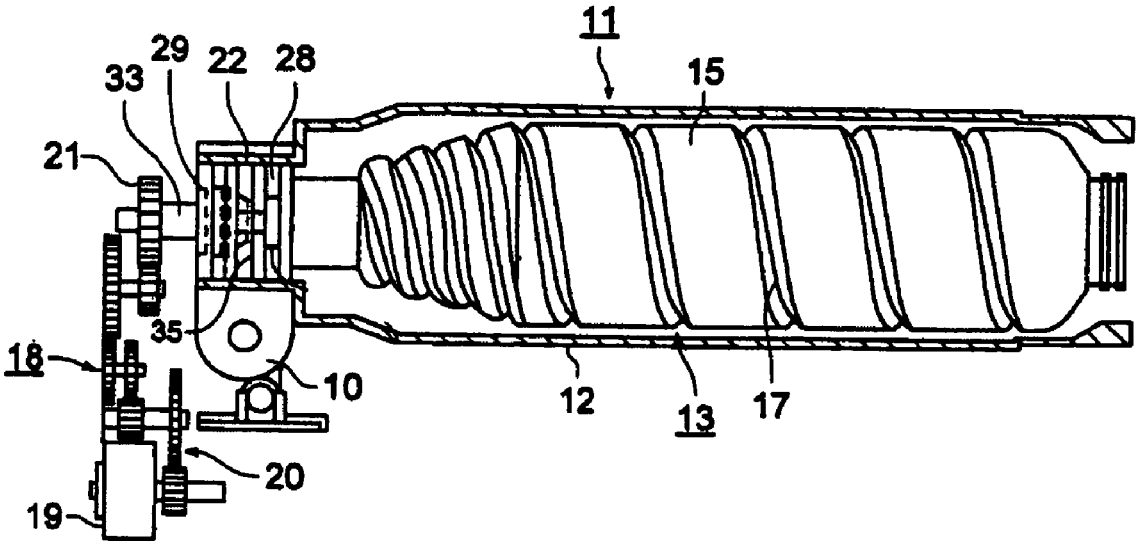
FIG. 6 is a cross sectional view of a toner supply apparatus.

Further, in the toner supply apparatus 11 a cylindrical toner container holding member 12 is secured on the development unit 10. A cylindrical toner container 13 filled with toner is inserted into this toner container holding member 12 rotatably in the horizontal direction. The following describes them with reference to drawings:

FIG. 2 is an external view of the toner container 13. FIG. 3 is an external view of the toner supply port of toner container 13 with cap removed. FIG. 4 is a cross sectional view of the toner supply port of a toner container 13 with cap removed. FIGS. 5(*a*) and (*b*) are enlarged cross sectional views representing part of the toner container 13. FIG. 6 is a cross sectional view of a toner supply apparatus 11.

In the toner container 13, one end of the cylindrical container body 15 is reduced in diameter and a toner supply port 16 is formed on at the tip of this reducing section 15*a*. A convex spiral flute 17 is provided on the inner periphery of the cylindrical container body 15 and a concave spiral flute 17 on the outer periphery. The rear of the cylindrical container body 15 is closed by a rear cap 24.

Namely, the toner container 13 is provided with reducing section 15*a* in such a way that the diameter of the portion close to the outlet of the cylindrical container body 15 is gradually reduced along the longitudinal axis of the container toward the outlet. This diameter reducing angle is preferred to be up to 45° with respect to the axial direction to which the outer wall of the container is orthogonal.

The cylindrical container body 15 is formed such that the spacing of spiral flute 17 is made narrow by the reducing section 15*a* on the side of the toner supply port. When toner is supplied to the development unit, rotary movement is given to the toner container 13 to rotate about the cylindrical center axis by the rotary drive member. With the rotation of the toner container 13, the spiral flute 17 serves as a rib that feeds powder to the toner outlet 35 at the tip of the toner supply port 16. In this case, the spacing of the spiral flute 17 gets narrower in the direction of the toner supply port 16, whereby toner transportability is drastically improved. Even if there is only a small amount of toner remaining in the toner container 13, toner is smoothly supplied to the development apparatus.

Furthermore, the toner container 13 is formed in such a way that the L/D as a ratio of the cylindrical length L cylindrical diameter D of the cylindrical container body 15 to cylindrical diameter D is $\frac{1}{2} \leqq L/D \leqq 10$, cylinder thickness t is 0.3 mm$\leqq$t$\leqq$5.0 mm, and cylinder thickness deviation is $\Delta t \leqq 20\%$.

If the L/D as a ratio of the cylindrical diameter D to cylindrical length L is smaller than the level given by $\frac{1}{2} \leqq L/D \leqq 10$, the toner feed rate becomes abnormally high. If it is greater, the toner feed rate becomes abnormally low. If it is kept within the range given by $\frac{1}{2} \leqq L/D \leqq 10$, then adequate toner feed rate will be provided.

Further, the toner container 13 is formed in such a way the cylinder thickness t is 0.3 mm$\leqq$t$\leqq$5.0 mm, and cylinder thickness deviation is $\Delta t \leqq 20\%$. For example, unless the difference between cylinder thickness t1 and cylinder thickness t2, namely the cylinder thickness deviation is $\Delta t \leqq 20\%$, as shown in FIG. 5(*a*), then the spiral flute 17 will be crushed, with the result that efficiency in the feed of toner inside the toner container 13 will be reduced.

For example, unless the difference between cylinder thickness t3 and cylinder thickness t4, namely the cylinder thickness deviation is $\Delta t \leqq 20\%$, as shown in FIG. 5(*b*), then the spiral flute 17 will be increased in size. Toner will remain where the thickness is smaller, with the result that efficiency in the feed of toner inside the toner container 13 will be reduced.

As described above, a cylinder thickness t is 0.3 mm$\leqq$t$\leqq$5.0 mm and a cylinder thickness deviation is $\Delta t \leqq 20\%$. This arrangement drastically improves the transportability of toner inside the toner container 13 by the spiral flute 17 and ensures smooth supply of toner into the development apparatus even when there is only a small amount of toner in the toner container.

The toner supply apparatus 11 in the present invention is configured as part of the development apparatus 5, and comprises a toner container 13, a cylindrical toner container holding member 12 and a rotary movement transfer member 18 for giving rotary movement to the toner container 13.

The rotary movement transfer member 18 comprises a motor 19, a gear group 20 rotated by the motor 19, a final gear 21 and a junction holder 22 equipped with a rotary shaft 33 engaged with the final gear 21.

The toner container 13 is inserted into the toner container holding member 12 and is linked with the junction holder 22 at the toner supply port 16 of the toner container 13. Rotary movement is given to the toner container 13 is by the rotary movement of the junction holder 22. The rotary movement of the toner container 13 is given when the amount or density of toner in the development unit 10 is insufficient. Toner of the toner container 13 is supplied to the development unit 10 by the toner outlet 35 at the tip of the toner container 13 through the rotation of the toner container 13.

The toner supply port 16 of the toner container 13 comprises a cap 27, a bellows internal cover 28 and a toner outlet member 29.

The junction holder 22 comprises a rotary shaft 33 engaged with the final gear 21. When the toner outlet member 29 as a tip of the toner container 13 is inserted into the junction holder 22, the bellows internal cover 28 is slid toward the toner container body to reach the opening. Then the toner outlet 35 is opened, and the toner container 13 is connected to the development unit 10 through the toner outlet 35. The toner container 13 is mounted in position.

Accordingly, when one wishes to mount the toner container 13 on the plain paper copying machine 1, one has only to remove the cap 27 of the toner supply port 16 of the toner container 13 in advance. Then there is no need of opening the bellows internal cover 28, and toner does not leak out of the toner outlet 35. At the same time, this arrangement prevents toner from contaminating the hands or clothes of the operator.

When the toner container 13 is taken out of the toner container holding member 12, the bellows internal cover 28 goes back to the original closed position. So the toner outlet 35 is covered with the bellows internal cover 28 so that toner attached to the tip of the toner container 13 does not leak out, and hence toner does not contaminate the hands or clothes of the operator.

The method of manufacturing the toner container 13 according to the present invention includes the method of forming plastic material; for example, blow molding such as natural parison blow and injection blow, injection molding, extrusion molding or formation of a flute after formation of a paper roll. The thickness of the toner container 13 is controlled in such a way that a specified thickness is obtained at the time of molding. Further, the preferred material of the container according to the present invention includes polyolefin based resin. Especially polyethylene and polypropylene are preferred.

In addition to the commonly known toner, toner stored in the toner container in the present invention is preferred to be polymerized toner characterized by comparatively uniform distribution of individual toner particle size and shape. Here polymerized toner is defined as toner that can be formed by generation of the toner binder resin and by polymerization of the monomer as material of the binder resin and subsequent chemical treatment, where the shape of the toner is determined in this process. To put it more specifically, it is the toner obtained by polymerization such as suspension polymerization or emulsion polymerization, and, if required, by the process of particles getting fused together in the process subsequent to this polymerization.

The polymerized toner stored in the toner container in the present invention is characterized by its specific shape. In other words, the preferred toner for this invention is characterized in that the toner particles with the shape coefficient ranging from 1.2 to 1.6 account for 65 number percent or more in number size distribution, and the variance coefficient of the shape coefficient does not exceed 16%. When such toner is used for the image forming apparatus, the vibration of a cleaning blade in the image forming apparatus is minimized.

Further, preferred polymerized toner used in the toner container in the present invention is characterized in that the variance coefficient of the shape coefficient does not exceed 16% and number size variance coefficient in number size distribution does not exceed 27%. Use of such toner has been found to improve cleaning property in the image forming apparatus and to ensure excellent reproducibility of the thin line of an image and high picture quality for a long time.

The preferred polymerized toner used in the toner container of the present invention is controlled in such a way that toner particles having no corner in toner account for 50 number % or more in number size distribution and the number size variance coefficient in number size distribution does not exceed 27%. Use of such toner has been found to ensure improved cleaning property, excellent reproducibility of the thin line and high picture quality for a long time.

The shape coefficient of the polymerized tone used in the toner container in the present invention can be represented by the following formula that shows the degree of the roundness of toner particles.

$$\text{Shape coefficient}=((\text{max. diameter}/2)2\times\pi)/\text{projected area}$$

In this case, the maximum diameter is defined as the width of a particle wherein the spacing between parallel lines is the maximum when the image of toner particle projected on the plane is sandwiched between these two lines. The projected area is defined as the area of the image of a toner particle projected on the plane.

The above shape coefficient was measured as follows: A toner particle was photographed in 2,000 magnifications with a scanning electron microscope, and photographic image was analyzed based on this photograph using the "Scanning Image Analyzer" (Nippon Denshi Kiki Co., Ltd.). In this case, the shape coefficient of this invention was measured using 100 toner particles according to the above calculation formula.

In the preferred polymerized toner, toner particles with this shape coefficient ranging from 1.2 to 1.6 account for 65 number percent or more in number size distribution. This composition provides more uniform triboelectrification on the developer feed member or the like without accumulation of excessively charged toner, and permits easier replacement of toner from the surface of the developer feed member, with the result that the problem of development ghost does not occur easily.

Further, since the toner particles are not easily crushed, toner can be stored in the container in the process of storing powder in the toner container without toner particles being crushed. Further, when the stored toner is supplied to the image forming apparatus, contamination of the electrostatic charging member is reduced and electrostatic charging property of toner is stabilized.

The variance coefficient of the polymerized toner used in the present invention is calculated from the following equation:

$$\text{Variance coefficient}=[S/K]\times 100(\%)$$

[In the equation, S denotes the standard deviation of the shape coefficient of 100 toner particles, and K denotes the average value of the shape coefficient.]

Since the variance coefficient of the shape coefficient does not exceed 16%, the gap of the transferred toner layer is reduced to improve the fixing property, so offset does not occur easily. Further, sharp distribution in the amount of electrostatic charge is ensured and picture quality is improved.

The number size distribution and number size variance coefficient of the polymerized toner preferably used in the toner container in the present invention are measured by the Coulter Counter TA-II or Coulter Multisizer (by Coulter Inc.). In the present invention, the measurement was made by connection with a personal computer via the interface for producing particle size distribution (by Nikkaki Corp.). An aperture of 100 μm was used in the Coulter Multisizer, and the volume and number size of 2 μm or more were measured to calculate the particle size distribution and average particle diameter. The number size distribution represents the relative frequency of the toner particle with respect to the particle diameter. The number size average particle diameter represents the median diameter in number size distribution.

Number size variance coefficient in the number size distribution of toner is calculated from the following equation:

$$\text{Number size variance coefficient}=[S/Dn]\times 100(\%)$$

[In the equation, S denotes the standard deviation in the number size distribution, and Dn denotes the number size average particle diameter (μm)].

Since the number size variance coefficient of the polymerized toner used in this invention is 27% or less, the gap of the transferred toner layer is decreased and the fixing property is improved. So offset does not occur easily. Further, sharp distribution in the amount of electrostatic charge is ensured and the transfer efficiency and picture quality are improved.

Figure 7:
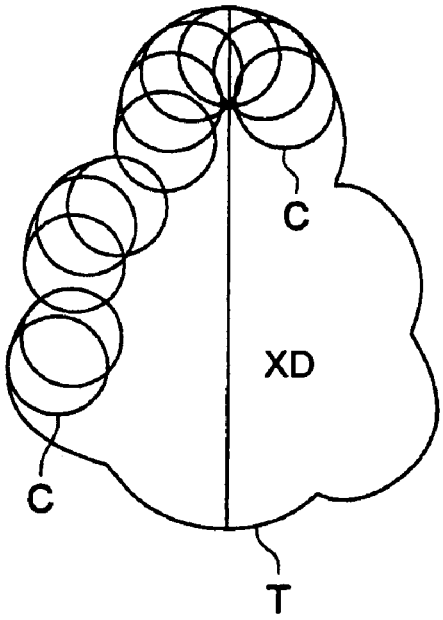
FIGS. 7(*a*), (*b*) and (*c*) are schematic diagrams showing the toner particle having no corner and toner particle having a corner.
Figure 7:
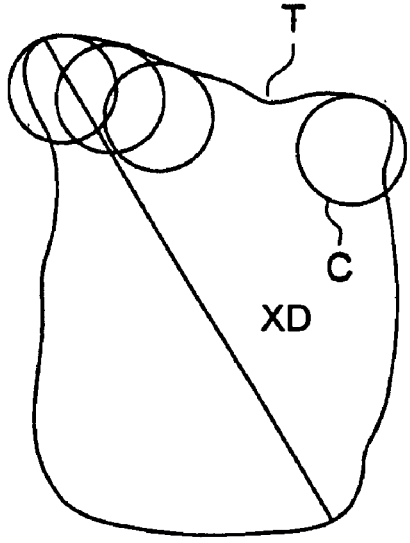
Figure 7:
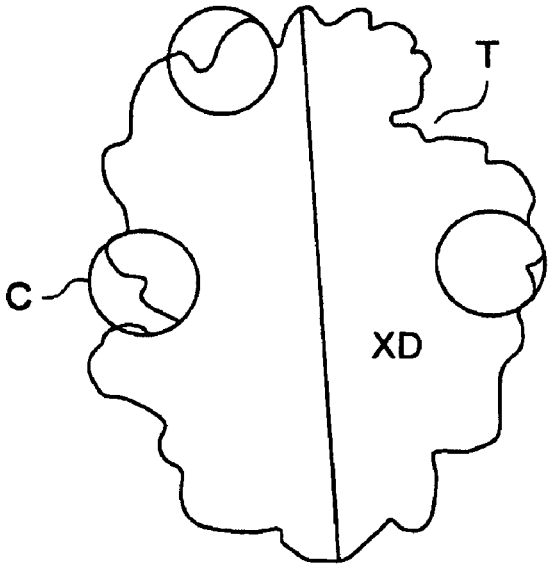

In the polymerized toner used in the toner container in the present invention, toner particles having no corner refer to such toner particles that have practically no projections where electrical charge tends to concentrate or projections susceptible to wear due to stress. Namely, as shown in FIG. 7(*a*), when the major diameter of a toner particle T is XD and a circle having a radius (XD/10) is rolled by keeping contact with the inside of the line around the toner particle T at one point, this circle C is not practically placed off the toner T. In this case, the particle is said to have no corner. "A circle is not practically placed off the toner T" means that the number of projections where there is any circle placed off the toner T does not exceed one. "The major diameter of toner particle" is defined as the width of the particle wherein, if an image of the toner particle projected on a plane is sandwiched by two parallel lines, the spacing of the parallel lines is the maximum. FIGS. 7(*b*) and (*c*) indicate the projected image of the toner particles having a corner.

Toner particles without corner were measured as follows: An enlarged photograph of a toner particle was taken by a scanning electron microscope, and was further magnified by 15,000 times. This photographic image was measured to see if it has a corner or not, in the sense as defined above. This measurement was applied to 100 toner particles.

In the toner used in this invention, the percentage of toner particles without corner accounts for 50% or more. This composition minimizes fine particles produced by stress with the developer feed member and reduces contamination on the surface of the developer feed member, with the result that sharp distribution in the amount of electrostatic charge and stable electrostatic charge property are ensured, and high picture quality is maintained for a long time.

The particle diameter of the polymerized toner used in the toner container according to the present invention is preferred to 3 to 8 μm in terms of number size average particle diameter. When toner particle is formed by polymerization method, this particle diameter can be controlled by the density of coagulant, the amount of the organic solvent to be added, fusion time or composition of the polymer itself. The number size average particle diameter is 3 to 8 μm, and this reduces the amount of toner having excessive or insufficient adhesion to the developer feed member in the fixing process and ensures stable development for a long time. At the same time, this feature improves the transfer efficiency and half-tone picture quality, and enhances the picture quality in terms of fine lines and dots.

The polymerized toner preferably used in the toner container according to the present invention can be manufactured by water based medium according to the suspension polymerization method or a method wherein monomer is emulsified and polymerized in the solution with emulsion added as required additive, and fine grained polymerized particles are produced; then organic solvent and coagulant are added to cause association. This tone can also be manufacturing by the method wherein, at the time of association, particles are mixed with dispersions such as mold releasing agent and coloring agent required for the composition of toner, or by the method wherein emulsification and polymerization are performed after the toner constituents such as mold releasing agent or coloring agent has been put in the monomer. Here "association" can be defined as fusion of multiple resin particles and coloring agent particles. Water based medium can be defined to mean a medium containing at least 50 percent by mass. The method for manufacturing polymerized toner preferably used in the present invention is disclosed in details in the Application for Japanese Patent No. Hei 11-304004.

Toner stored in the toner container according to the present invention is not restricted to the monochrome toner using a coloring agent of black; it can be color toner obtained from the coloring agent of chromatic color.

The polymerized toner used in the toner container according to the present invention can be the tone mixed with fine particles such as inorganic particles or organic particles as external agents in order to improve fluidity. For example, inorganic oxide particles such as silica, titania and alumina are preferred as inorganic particles. These inorganic particles can be the ones having been subjected to hydrophobic treatment using titanium coupler or the like.

[Description of the Preferred Embodiments-2]

The following describes the embodiments according to the present invention with reference to drawings, without the embodiments of the present invention being restricted thereto:

FIG. 8(*a*) is a perspective view representing a powder container according to the present invention, wherein the opening is sealed by the film-like sealing material. FIG. 8(*b*) is a cross sectional view (along line A—A of FIG. 8(*a*)) of the opening to supply powder.

Numeral 201 denotes a container body—a rigid container with at least one ends open, which can be obtained by injection molding or hollow molding of the thermoplastic resin to be described later. Numeral 202 denotes a fixed cover, which is preferred to be made of the same type of resin as the container body 201. The fixed cover 202 molded integrally with the container body 201 as a plastic molding is preferred from the viewpoint of reducing the number of parts, shortening the container assembly process and reusing the container.

Numeral 203 denotes a base provided on the open end of the container body 201. It is preferred to be made of the same type of resin as the container body 201. The base 203 integrally with the container body 201 is preferred for the same reasons as those of the aforementioned fixed cover. When the container body according to the present invention has a slide cover 205 shown in FIGS. 14(*a*) and 14(*b*) to be described later, the base 203 has projections engaged with the slide of the slide cover 205 on the right and left along the slide.

Numeral 204 denotes a sealing material for sealing the opening 2032 of the base 203 as a sealing member according to the present invention. It is bonded on the surface about the base 203 as the bottom end surface of the base 203 in such a way that it can be separated and removed. Multiple projections 2333 provided with regularity to be described later are arranged on the lower end surface 2033 of the base 203. The sealing material 204 is bonded by adhesive, seal sealing, pressure and other well known method. In the present invention, heat sealing is preferred. As shown in FIG. 8(*a*), the tip of the film-like sealing material 204 is bonded and fixed firmly to the tip securing section 2321 located close to one of the base 203. The film-like sealing material 204 is bonded removably to the lower end surface 2033. The extension is folded back at the other end of the base 203. As described above, when the extension of the film-like sealing material 204 is folded back and the film-like sealing mater 204 is separated in the folded state, then the separation angle on the lower end surface 2033 becomes acute to permit easy separation.

The film-like sealing material 204 is required to be made of a material that is a flexible highly resistant against rupture, such as polyester film, a laminate between polyethylene and polyester, a laminate between polypropylene and polyester and a laminate of polyethylene or polypropylene on the aluminum foil. Preferably, it should be made in multiple layers comprising of multiple types of film, and the surface on the side in contact with the lower end surface 2033 provided with multiple projections should be made of a hermetic material normally called sealant.

Figure 11:
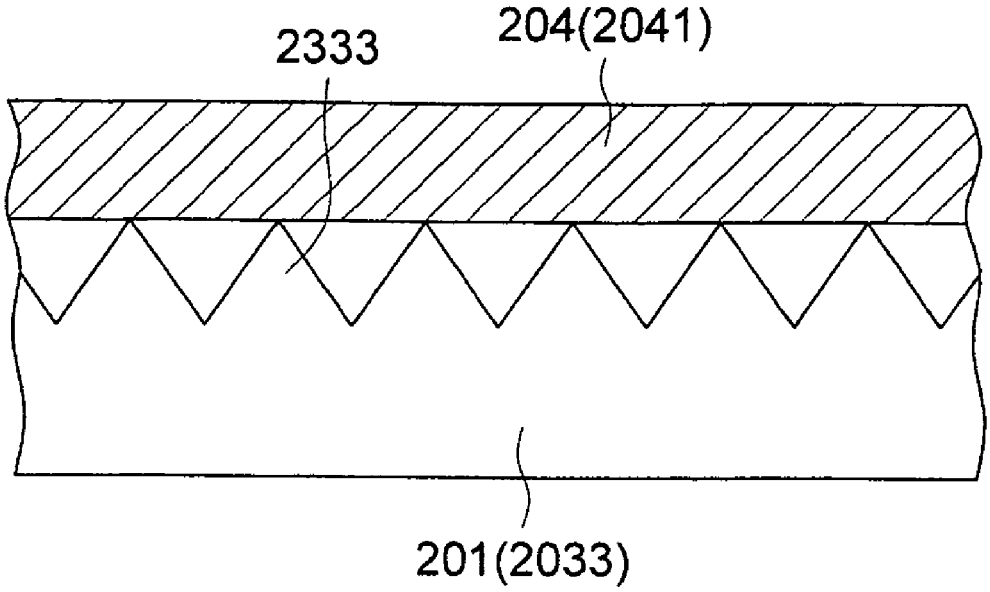
FIGS. 11(*a*) and (*b*) are schematic diagrams representing contact between multiple projections and film-like sealing material.
Figure 11:
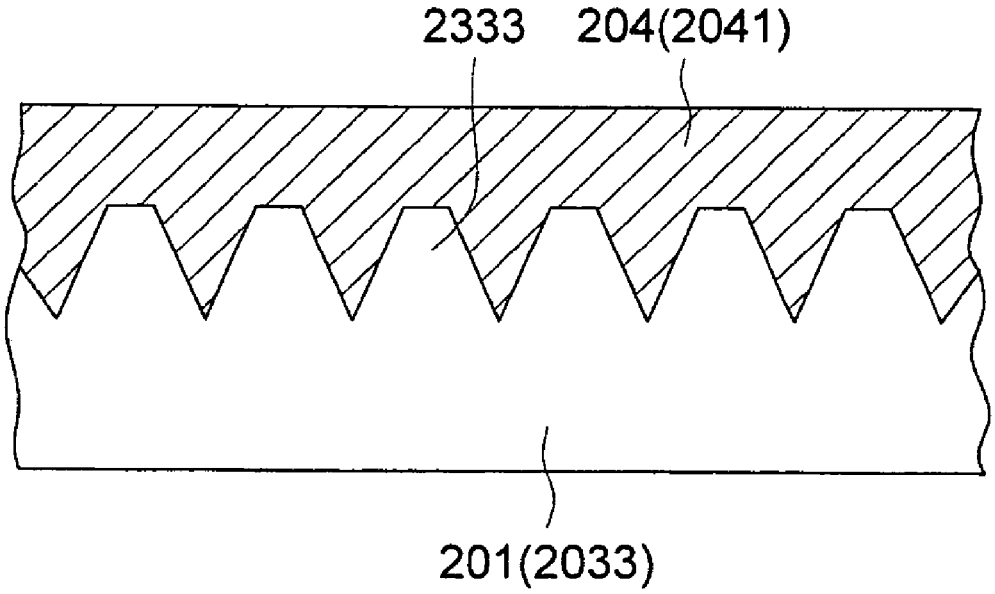

FIGS. 11(*a*) and (*b*) are schematic diagrams representing contact between film-like sealing material 204 and multiple projections 2333 arranged at the opening of the container body 201 according to the present invention. FIG. 11(*a*) shows the state before heat sealing, while FIG. 11(*b*) shows the state after heat sealing. Before heat sealing as shown in FIG. 11(*a*), the film-like sealing material is in contact with only the tips of the projections 2333 arranged on the side of the container body 201. After heat sealing as shown in FIG. 11(*b*), the tips of the projections 2333 are slightly fused with the film-like sealing material by the heat applied during heat sealing. On the side of the film-like sealing material 104, the gap between projections 2333 is uniformly filed by the fusion of the sealant 2041 so that excellent hermeticity is provided. In the present invention the film-like sealing material 204 is formed in a multiple layer structure. In FIGS. 11(*a*) and (*b*), only the sealant layer is shown, and other layers are not illustrated.

Figure 9:
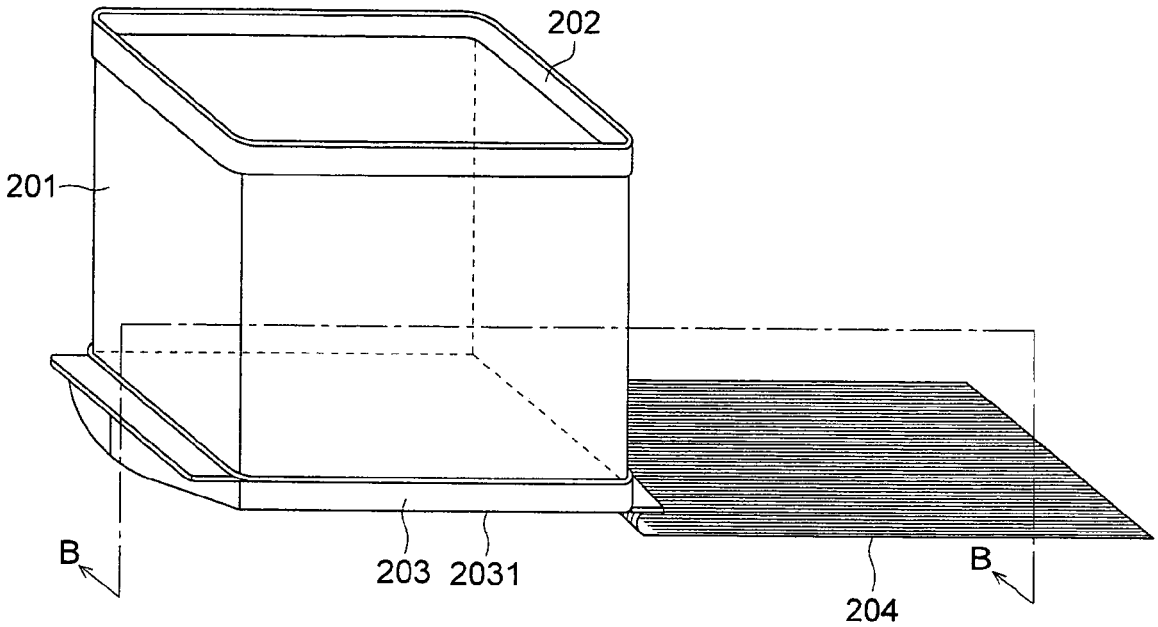
FIGS. 9(*a*) and (*b*) are a perspective view of the powder container with film-like sealing material removed from the container body and a cross sectional view showing the opening.
Figure 9:
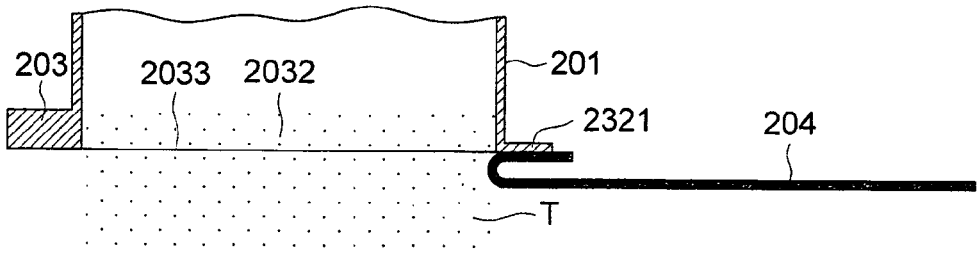
Figure 10:
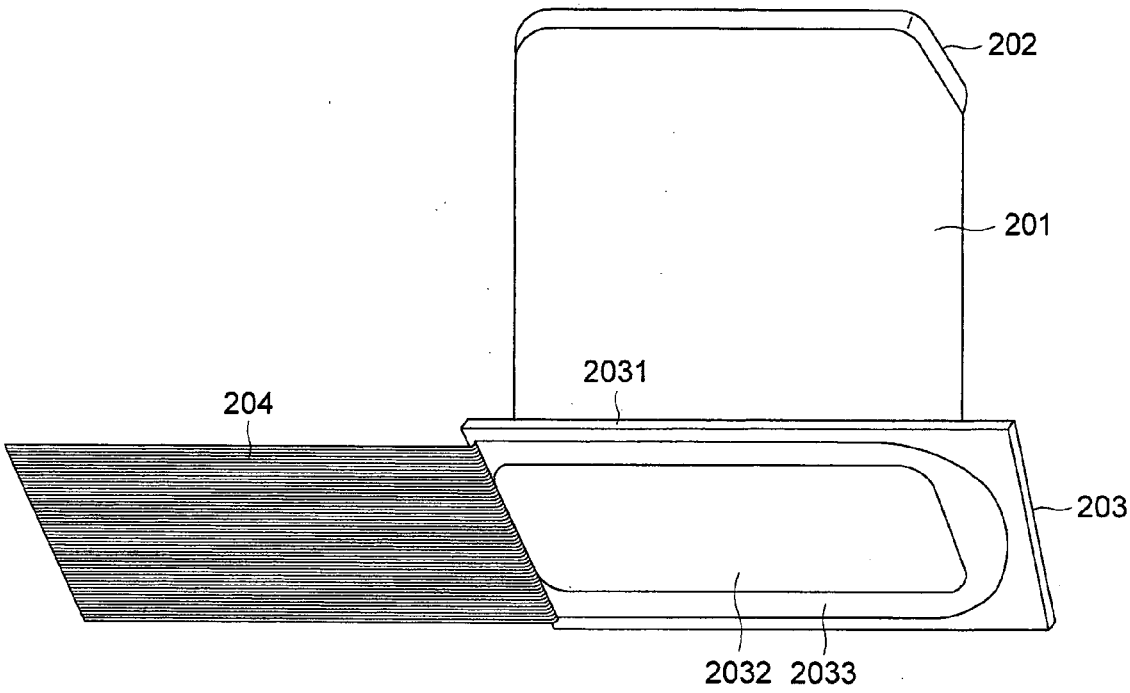
FIG. 10 is a perspective view of the powder container of FIG. 9 (a), as viewed from the opening side.

FIG. 9(*a*) is a perspective view of the powder container with film-like sealing material 204 removed from the container body 1. FIG. 9(*b*) is a cross sectional view taken along line B-B. FIG. 10 is a perspective view of the powder container under the same condition as viewed from the bottom. The multiple projections arranged around the opening in the present invention are arranged on the lower end surface 2033 of the opening 2032.

When the film-like sealing material 204 of the powder container sealed by the film-like sealing material 204 is pulled by the opening of the container body 201 in FIG. 8(*a*), in the direction of acute angle with respect to the surface of contact between the container body and film-like sealing material, the lower end surface 2033 of the opening 2032 is gradually separated. When the film-like sealing material 204 is sufficiently pulled out to the right as shown in FIG. 9(*a*), the opening 2032 is opened and powder T in the container body 201 is supplied by gravitation.

In the powder container in the present invention, multiple projections are arranged on the lower end surface 2033 of the container body 201. This arrangement reduces the frictional coefficient with the lower end surface 2033 as a contact point between the film-like sealing material 204 and container body, thereby facilitating separation of the film-like sealing material 204 the lower end surface 2033.

The following describes the multiple projections arranged on the container body side of the powder container according to the present invention:

The multiple projections arranged on the powder container in the present invention are provided with layout regularity. This layout ensures a firm bondage with the film-like sealing material 204 and smooth separation of the film-like sealing material from the container body 201 without much force applied.

In the present invention, a powder container with multiple projections arranged on the side of the container body has been discovered. This discovery has brought about rigid adhesion and smooth separability between the container body and film-like sealing material under mild conditions, thereby reducing the load on the container body and promoting reuse of the powder container.

In the aforementioned prior art, the contact surface between the container body 201 and film-like sealing material 204 required smoothness of less than 10 $\mu$m in terms of the difference between projections and depressions. This concept was based on the concept that formation of projections and depressions on two contact surfaces would cause powder to leak out of the gap between them, or allows powder quality to be deteriorated by entry of moisture outside the container through the gap. By sharp contrast, projections are arranged between the container body and film-like sealing material in the present invention, and it has been discovered that deliberate formation of projections and depressions never causes any leakage of powder container or any deterioration of powder quality due to the influence of external environment. It goes without saying that this has never been predicted from the prior art.

Leakage of powder or deterioration of stored powder quality does not occur despite multiple projections arranged between the container body and film-like sealing material in the present invention. The reason for this phenomenon is not very clear. It is possible to consider as follows: Since some regularity is given to the projections arranged on the container body, even if a gap is formed at the contact position between the container body and film-like sealing material, mutual packing of powder particles occurs close to the gap, and this prevents leakage of powder particles from the gap or entry of moisture. However, this is not yet clear.

Figure 12:
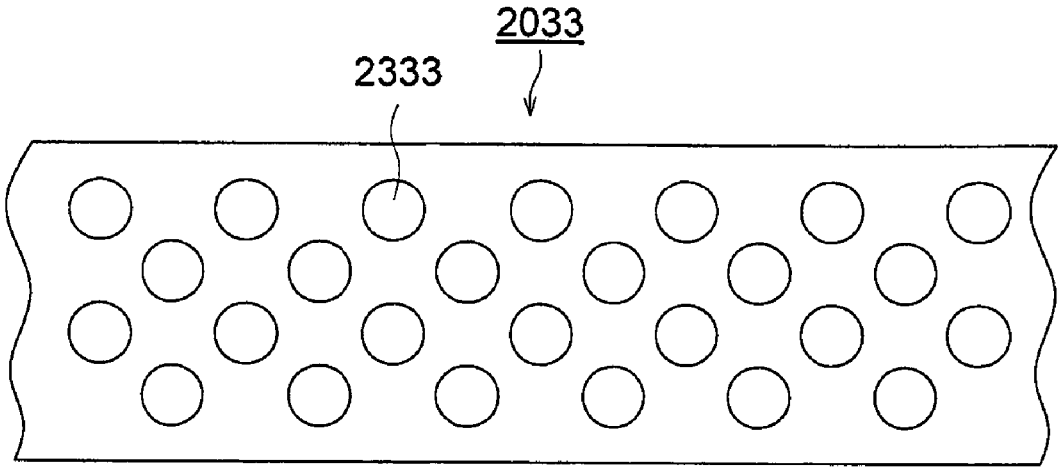
FIGS. 12(*a*) and (*b*) are drawings representing various arrangements of multiple projections.
Figure 12:
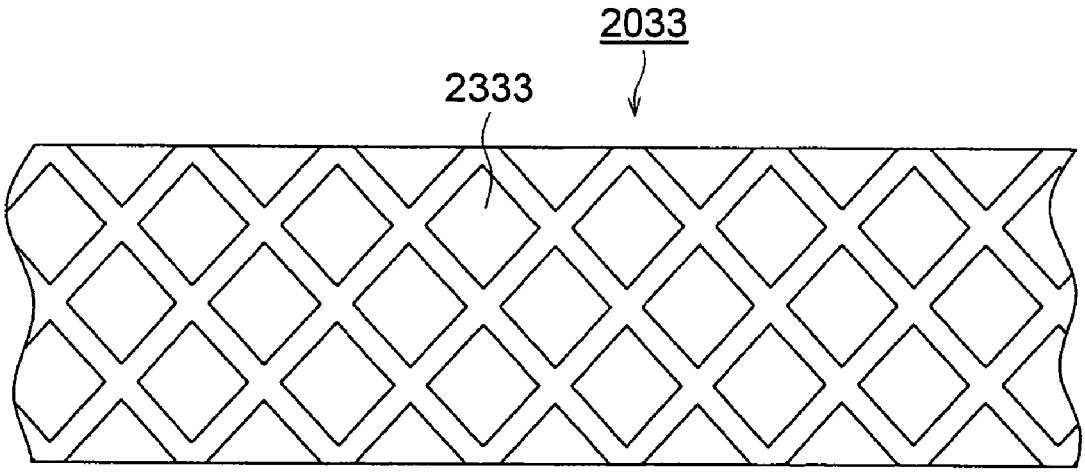

As described above, multiple projections arranged on the container body of the powder container in the present invention are provided with some regularity. To put it more specifically, this regularity is found in (1) shape, (2) height, (3) spacing, (4) density and (5) sectional form. The following describes their details:

Multiple projections in the present invention have regularity in shape. For example, they include projections having an island structure shown in FIG. 12(*a*) and a network structure in FIG. 12(*b*), without being restricted thereto.

The height of the projections in the present invention is 30 $\mu$m and over up to and including 300 $\mu$m, preferably 70 $\mu$m and over up to and including 200 $\mu$m. Here the height of the projections can be defined as the distance indicated by "h" shown in FIG. 13(*a*).

The projections in the present invention are arranged at spacings of 10 $\mu$m and over up to and including 500 $\mu$m, preferably 100 $\mu$m and over up to and including 300 $\mu$m. Here the spacing of projections can be defined as the distance between the highest positions of the projection as shown by "d" in FIGS. 13(*b*) through (*d*). Further, when the sectional form of the projection is rectangular, then it refers to the distance between the intermediate points between the highest points as shown in FIG. 13(*d*).

It has been verified that the projections in the present invention can be preferably laid out at a density of 10 projections per square millimeter and over up to and including 1,000 projections per square millimeter.

The projections in the present invention are preferred to have a sectional form which is rectangular, triangular, semicircular and trapezoidal as shown in FIGS. 13(*a*) through (*d*). The projections in the present invention have these sectional forms. This configuration ensures that the projection tips at the time of heat sealing are uniformly fused. When the container is reused, it is possible to maintain the bonding strength and smooth separability such that there is no problem with distribution as a powder contained product, despite repeated heat sealing with the film-like sealing material 204, despite repeated reuse.

The aforementioned projections arranged on the container body in the present invention can be observed by a magnifier to check the shape and sectional form on a quantitative basis. Based on the photograph taken by an optical microscope and electron microscope, it is possible to check the quantitative measurement of the height, spacing and density of the projections and the sectional form.

The following describes the adhesion at the contact position between the multiple projections and film-like sealing material in the present invention:

A specific way of arranging multiple projections in the present invention includes the method where projections are formed at the position of a die corresponding to the surface of the container body by etching sand blasting and electrical discharging, or projections of network structure are formed by cutting the die. Another method is to form projections at the contact position between the container body and film-like sealing material by optical photographing using optically reactive resin, and the photographed image are subjected to cutting or etching, thereby forming projections. To determine such layout characteristics of the aforementioned projections as the sectional form, height, spacing and density, the setting conditions of aforementioned projection producing equipment are selected and controlled, whereby intended projections can be formed.

The specific method of fusing between the projections and film-like sealing material in the present invention is not restricted in particular. One fusing method is to use a conventionally used pressure member comprising a rubber-like elastic body and Teflon (polytetrafluoroethylene) sheet to perform fusing. It is also possible to perform heat sinking using the ultrasonic wave. When heat sealing technique is used for fusion between flexible film-like sealing material and rigid container body constituting the powder container in the present invention, a reliable method for fusing is to apply pressure by pressing one against the other.

When the container body of the powder container in the present invention is fused with the film-like sealing material by heat sinking, the melting point or softening point of the resin constituting the container body are 5 to 50° C. higher than those of the sealant constituting the film-like sealing material. This arrangement is preferred because it provides smooth separability and maintains the profile of the projection tips deformed by fusing, without being damaged.

Measurement by a flow tester, for example, is one of the methods for measuring the softening point of the resin constituting the container body. To put it more specifically, a predetermined amount of a resin sample is placed in the measuring instrument of the flow tester CFT 500 (by Shimadzu Seisakusho Ltd.), and the softening point is measured.

The arrangement to ensure that the projection tips are not damaged is important in the sense that uniform and rigid adhesion of the film-like sealing material onto the container body can be maintained and secured, despite repeated reuse of the container, and it is possible to ensure that the chips of projections produced by damage are not mixed into the stored powder when the container is filled with powder, or powder contained product quality is not deteriorated.

The following describes the resin material constituting the container body 201 in the present invention:

The resin material constituting the container body 201 in the present invention can be any thermoplastic resin if it can be molded. It is not restricted to any particular material. To put it more specifically, such materials include polypropylene, polyethylene (PE), ABS resin and high impact polyethylene (HIPS). Of these, polypropylene, polyethylene and high impact polyethylene (HIPS) are preferably used.

Injection molding and hollow molding methods can be considered to mold the container body 201 in the present invention. The aforementioned resins are used in these methods, but not all resins can be used in either of these methods. Especially when resin is used to manufacture toner container, it is preferred to select the resin whose physical property values such as melt index and whose density are kept within a certain range, in order to ensure that the container will not be damaged by shock during transportation and operation as well as by repeated use.

In injection molding, resin is poured into the gap of dies, and this requires an adequate flow characteristics. It is preferred to use the resin where the melt index value lies within the range from 1 to 30 g/10 min. as in the case of polypropylene and the density stays within the range of 0.94 to 0.97 g/cm$^3$ as in the case of polyethylene. If the melt index is smaller than the value in this range, flow characteristics will deteriorate and uneven filling of resin in the die will occur, with the result that uneven outer thickness of the container wall and insufficient strength will be caused. If the melt index is greater than the value in this range, flow characteristics will be improved and uniform filling of resin in the die will be ensured, but thermal stability and holding characteristics will deteriorate. Either case is not appropriate for a container to be reused.

In hollow molding, resin is poured in the dies and compressed air is blown into the resin with resin sandwiched between dies so that resin will be inflated and brought in close contact with the die surfaces. Then resin is cooled solidified for molding. In this method, good results can be gained by using the resin whose value of melt index is kept within the range from 0.1 to 4 g/10 min. as in the case of polypropylene and whose density lies within the range of 0.94 to 0.97 g/cm$^3$ as in the case of polyethylene. If the melt index is smaller than the value in this range, flow characteristics of the molten resin will deteriorate. So uniform inflation is difficult in the process of inflation by compressed air, uneven outer thickness of the container wall will result, and container stability against shock will deteriorate. Further, if the melt index is greater than the value in this range, flow characteristics will be unstable due to excessive ease in flow, and resin tends to remain especially on the lower end. A difference occurs in thickness between the upper and lower portions of the outer wall of the container, with the result that stability against shock is reduced. Either case is not applicable to the container to be reused.

To prevent the container from being damaged when subjected to impact, the specific Izod impact value is preferred to be within the range from 0.1 to 30. If the Izod impact value is smaller than a value in this range, the container will be easily damaged by impact. So this is not applicable to the container to be reused. If the Izod impact value is above a certain range, the container can withstand the practical impact, i.e. the impact that the container body is assumed to be subjected to in the process of physical distribution in reuse. The problem is solved when the Izod impact value lies within the aforementioned range.

For example, the high-density polyethylene as a resin material preferably used for the container body in the present invention has a density of 0.94 through 0.97 g/cm$^3$. The density is measured according to JIS K 7112. It is simple and convenient to use a pycnometer for this measurement.

To put it more specifically, a cleaned and washed pycnometer is prepared, and its mass is measured accurately. This measurement is assumed as b (g). Then immersion liquid is filled up to the marked line at a temperature of 23±0.1° C., and the mass is measured accurately. This measurement is assumed as e (g). Then the pycnometer was made empty and dried and about 1 to 5 grams of a sample was put therein. The mass of the pycnometer is measured with the sample put inside again, and the mass of the dried pycnometer is subtracted from this measurement to obtain the mass of the sample. This is assumed as a (g). Then immersion liquid is added into the pycnometer with sample placed therein. It is placed in a vacuum desiccator with the sample covered. Pressure is reduced to remove air from the immersion liquid. Immersion liquid is added to the pycnometer up to the marked line at a temperature of 23±0.1° C. with air removed from the immersion liquid. The mass is measured. This measurement is assumed as c (g). The density is obtained from this result according to the following calculation formula:

$$\text{Density } (g/cm^3)=\{(a)/((e-b)-(c-e))\}\times\rho$$

where ρ denotes a specific gravity of immersion liquid at 23° C.

For the physical properties, polypropylene is preferred to have a density of 0.90 to 0.91 g/cm$^3$, for example.

Definition of the Izod impact value and measurement method are given in JIS K 7110, and definition of melt index and measurement method are shown in JIS K 7210. These are the basis for measurement. Polypropylene is measured at 230° C./2.16 kg and polyethylene is measured at 190° C./2.16 kg.

The resin material used in the container body in the present invention is preferred to have a melting point or softening point of 5 to 50° C. higher than the sealing temperature. The container body in the present invention has multiple projections arranged at the position in contact with the film-like sealing material. The container body and film-like sealing material are pressed and fusion is made by heat sealing. In the aforementioned temperature range, projection tips are uniformly and regularly crushed and are fused with film-like sealing material. Despite repeated fusion of the film-like sealing material at the time of reuse, it is possible to ensure adhesion with the strength to withstand the impact estimated when subjected to physical distribution at the position in contact with the film-like sealing material. At the same time, smooth separability can be reproduced at the time of separation. These facts have been verified.

The powder container in the present invention can be a powder container having a sealing material tractive member such as a slide cover 205 as shown in FIG. 14(*a*), (*b*). Since the film-like sealing material 204 is separated through the sealing material tractive member, this arrangement provides simple and reliable separation of the film-like sealing material, and allows reliable protection of the film-like sealing material 204 in storage and transportation. Further, since the seal material tractive member is used to separate the film-like sealing material, the force added to the film-like sealing material is reduced and this force is applied uniformly. These characteristics are expected to ensure recycling of the film-like sealing material without causing deformation or deterioration of the film-like sealing material due to separation. In the present invention, use of the resin of the same series is preferred for both the seal material tractive member and container body. In FIGS. 14(*a*),(*b*), the powder container having a slide cover 205 as a seal material tractive member is provided with the slide groove 2051 engaged with the projection section 2030 of the base 203.

In the present invention the thickness of the outer wall constituting the powder container is not restricted in particular. To maintain durability, this thickness is preferred to be 1.0 mm or more. If the thickness of the outer wall is not even, it will be fragile when shock is applied. An allowance of the thickness of 1.0 mm or less, preferably 0.5 mm or less is preferred. This allowance of thickness shows the difference between the average thickness and minimum thickness. The average thickness refers to the average value of the measured values obtained by random measurement at ten positions except for bent portions. The minimum thickness is the value at the position out of these ten positions where the minimum value is measured.

In the powder container of the present invention, powder stored in a container mounted on an apparatus is replenished or supplied to the apparatus. There is no restriction to the powder to be stored in the container. It can be represented, for example, by various types of powder products including powder paint, starch, edible powder, cosmetics such as toilet powder and lime for drawing lines. This powder container can be preferably used as an electrostatic image development toner container used in electrophotographic image formation.

The following describes the electrostatic image development toner container (hereinafter referred to as "toner container") in the present invention:

Toner filled in the electrostatic image development toner container in the present invention comprises the coloring particles including at least binding agent and coloring agent in addition to other additives to be used as required. The average particle diameter is normally 1 to 30 $\mu$m, preferably 2 to 8 $\mu$m, in terms of volume mean particle diameter. There is no restriction to the bonding resin constituting the coloring particle. Various resins known in the prior art can be used.

For example, there are styrene resin, acryl resin, styrene/acryl resin and polyester resin. There is no restriction to the coloring agent. The known organic and inorganic pigments are used. To put it more specifically, carbon black and nigrosin are used as black toner. Pigments such as C.I. pigment blue 15: 3, C.I. pigment blue 15, C.I. pigment blue 15: 6, C.I. pigment blue 68, C.I. pigment red 48: 1, C.I. pigment red 122, C.I. pigment red 212, C.I. pigment red 57: 1, C.I. pigment yellow 17; C, C.I. pigment yellow 81, C.I. pigment yellow 154 are preferably used as pigments required for yellow, magenta and cyan toner.

Other additives, for example, include electric charge inhibitor such as salicylic acid derivative and azo metal complex, and fixing improver such as low-molecular polyolefin and carnauba wax.

Referring to the embodiments, the following describes the details of the present invention, without the embodiments of the present invention being limited thereto. "part" in the following description refers to "part by mass".

Example of Toner Production 8 parts of carbon black as coloring agent and 6 parts of low-molecular polypropylene were added to 100 parts of styrene acryl resin, and were dry-blended. Then this was molten, kneaded, crushed and classified. Then 0.7 part of hydrophobic silica was added as external additive to get toner having a volume mean particle diameter of 8.4 $\mu$m.

[Arrangement of Toner Container]

Containers 1 to 5, 7 and 8 according to the present invention shown in Table 1 and those having the arrangements shown in FIGS. 8 and 9 were manufactured. The container 6 in the present invention was assumed as a container having a seal material tractive member of FIG. 14. Polypropylene (PP) and polyethylene (PE) were used as resins.

The containers 1 to 8 in the present invention are provided with the projections under the conditions shown in Table 2, whereas the containers 1 to 4 for comparison are not provided with projection.

TABLE 1

| Container number | Resin type | Melt index | Izod impact value | Density (g/cm$^3$) | Molding | *1 |
|---|---|---|---|---|---|---|
| Container 1 of present invention | PP | 10.1 | 5.5 | 0.904 | Injection molding | With |
| Container 2 of present invention | PP | 10.1 | 5.5 | 0.904 | Injection molding | With |
| Container 3 of present invention | PP | 10.1 | 5.5 | 0.904 | Injection molding | With |
| Container 4 of present invention | PE | 11.2 | 5.0 | 0.957 | Injection molding | With |
| Container 5 of present invention | PE | 11.2 | 5.0 | 0.957 | Injection molding | With |
| Container 6 of present invention | PE | 11.2 | 5.0 | 0.957 | Injection molding | With |
| Container 7 of present invention | PP | 1.3 | 4.5 | 0.904 | Hollow molding | With |
| Container 8 of present invention | PE | 0.2 | 20.4 | 0.961 | Hollow molding | With |
| Container 1 for comparison | PP | 10.1 | 5.5 | 0.904 | Injection molding | Without |
| Container 2 for comparison | PE | 11.2 | 5.0 | 0.957 | Injection molding | Without |
| Container 3 for comparison | PP | 1.3 | 4.5 | 0.904 | Hollow molding | Without |
| Container 4 for comparison | PE | 0.2 | 20.4 | 0.961 | Hollow molding | Without |

*1; With/without projections

TABLE 2

| | Conditions on projections | | | | | |
|---|---|---|---|---|---|---|
| Container number | Projection shape | Sectional form | Height ($\mu$m) | Spacing ($\mu$m) | *1 | *2 |
| Container 1 of present invention | Island structure | Rectangular | 70 | 100 | 750 | 30 |
| Container 2 of present invention | Island structure | Rectangular | 30 | 10 | 1000 | 10 |
| Container 3 of present invention | Island structure | Rectangular | 300 | 500 | 10 | 70 |
| Container 4 of present invention | Network structure | Triangular | 195 | 300 | 400 | 50 |
| Container 5 of present invention | Island structure | Circular | 100 | 150 | 500 | 40 |
| Container 6 of present invention | Network structure | Trapezoidal | 250 | 200 | 100 | 65 |

TABLE 2-continued

| Container number | Conditions on projections | | | | | |
|---|---|---|---|---|---|---|
| | Projection shape | Sectional form | Height (μm) | Spacing (μm) | *1 | *2 |
| Container 7 of present invention | Island structure | Triangular | 40 | 5 | 1300 | 7 |
| Container 8 of present invention | Network structure | Triangular | 400 | 550 | 8 | 74 |
| Container 1 for comparison | — | — | — | — | — | 30 |
| Container 2 for comparison | — | — | — | — | — | 50 |
| Container 3 for comparison | — | — | — | — | — | 70 |
| Container 4 for comparison | — | — | — | — | — | 50 |

*1; Density (number/mm$^2$)
*2; Ratio of container height to seal member thickness(%)

<Evaluation>

After the aforementioned toner was put into the aforementioned containers and sealing was provided, separability was evaluated at a low temperature and humidity (5° C., 10% RH). Separation test was repeated ten times and evaluation was made on the force required for separation of the sealed portion, rupture of the sealing material at the time of separation and presence or absence of toner leaking from the sealed portions prior to starting the separation test. Separation test was not conducted when toner leakage was verified. The results of this test are given in Table 3.

TABLE 3

| Toner leakage | 1st | | 4th | | 10th | | Toner leakage |
|---|---|---|---|---|---|---|---|
| | *1 | *2 | *1 | *2 | *1 | *2 | |
| Container 1 of present | Good | 7.8N | Good | 8.8N | Good | 7.8N | No leakage up to tenth test |
| Container 2 of present | Good | 11.8N | Good | 11.8N | Good | 10.8N | No leakage up to tenth test |
| Container 3 of present | Good | 10.8N | Good | 9.8N | Good | 9.8N | No leakage up to tenth test |
| Container 4 of present | Good | 7.8N | Good | 7.8N | Good | 6.9N | No leakage up to tenth test |
| Container 5 of present | Good | 9.8N | Good | 10.8N | Good | 10.8N | No leakage up to tenth test |
| Container 6 of present | Good | 6.9N | Good | 6.9N | Good | 5.9N | No leakage up to tenth test |
| Container 7 of present | Good | 13.7N | Good | 12.7N | Good | 12.7N | No leakage up to tenth test |
| Container 8 of present | Good | 15.7N | Good | 15.7N | Good | 14.7N | No leakage up to tenth test |
| Container 1 for comparison | Seal rupture | 44.1N | — | — | — | — | Leaked in the second test |
| Container 2 for comparison | Seal rupture | 50.9N | — | — | — | — | Leaked in the fourth test |
| Container 3 for comparison | Seal rupture | 47.0N | — | — | — | — | Leaked in the second test |
| Container 4 for comparison | Seal rupture | 49.0N | — | — | — | — | Leaked in the third test |

*1; Separation
*2; Force required at the opening (N)

It has been verified that the containers 1 to 8 in the present invention can be separated without any problem under the low-temperature and low-humidity conditions and stable separability can be maintained despite repeated separation. In the containers without projection for comparison purposes, it has been verified that rupture occurs from the first test and toner leaks out of the sealed portion as separation is repeated.

[Description of the Preferred Embodiments-3]

Figure 15:
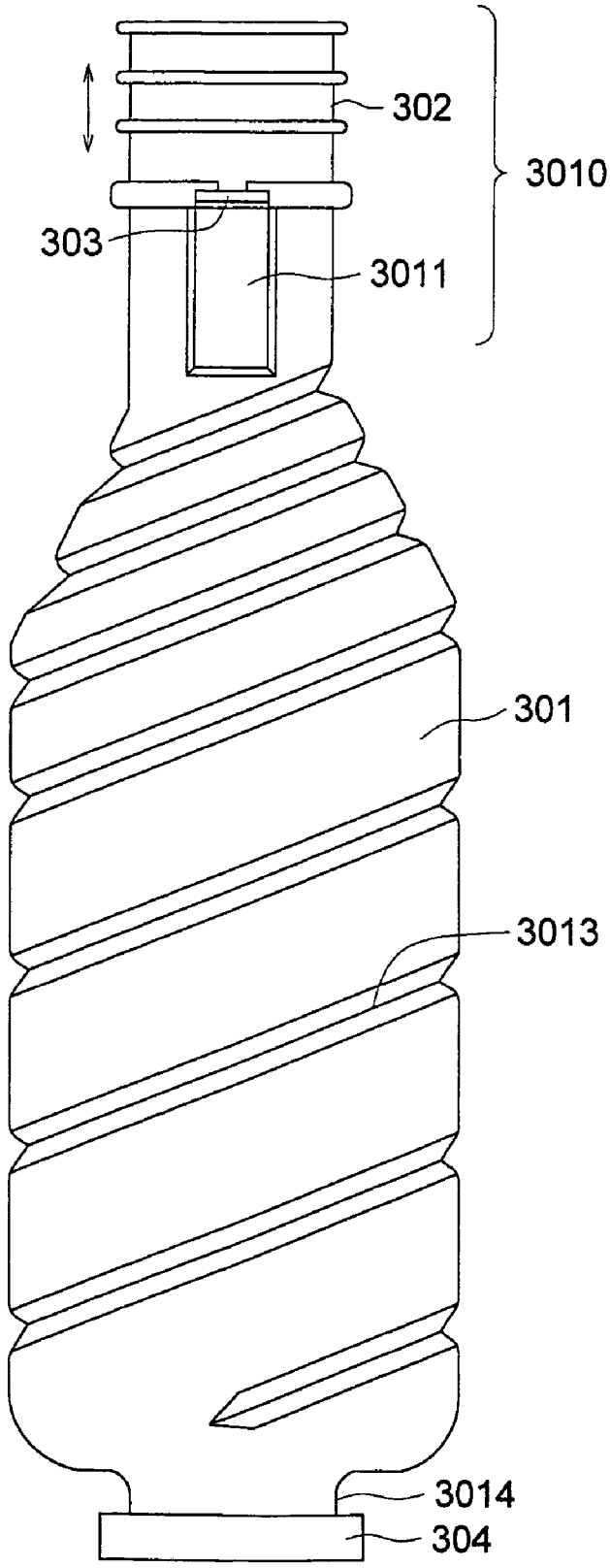
FIG. 15 is an external view of a powder container as an example of the present invention.

FIG. 15 is an external view of a cylindrical powder container for storing electrostatic image development toner an example of the powder container of the present invention. This powder container is integrally engaged with an engagement member 302 linked at the tip 3010 of the container body 301 through a locking member 303. A rectangular flute 3011 is provided on the tip 3010 of the container body 301, and the tip of the aforementioned locking member 303 inserted into this flute 3011 to enable the engagement member 302 mounted on the tip of the container body 301 to be moved reciprocally in the arrow marked direction. Further, the container body 301 has a convex spiral flute 3013 on the inner periphery of the cylindrical form and a concave spiral flute 3013 on the outer periphery of the cylindrical form. The rear 3014 of the container body 301 is closed by a rear cap 304.

Figure 16:
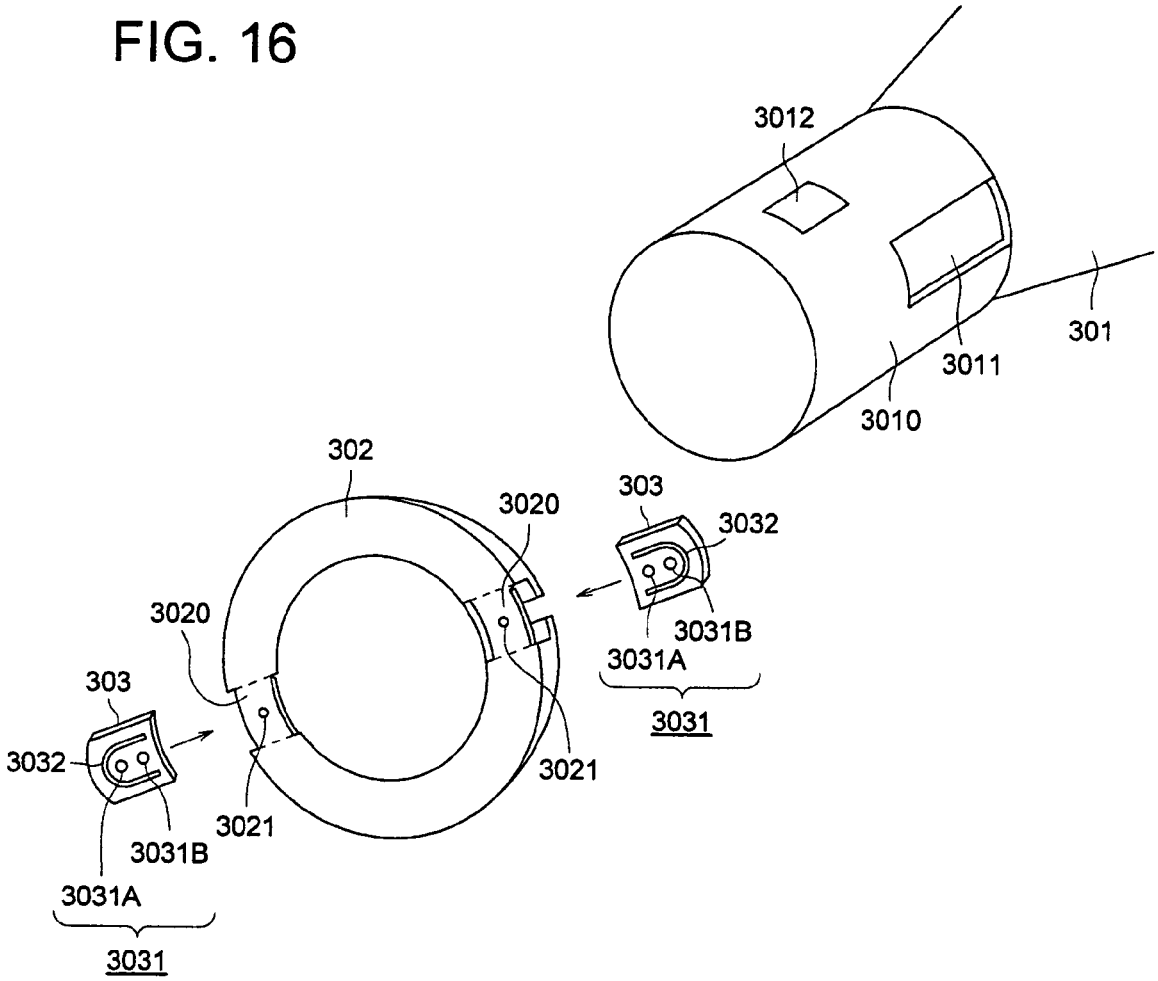
FIG. 16 is a perspective view around the tip of the container body of the powder container in FIG. 15.

FIG. 16 is a perspective view of the structure around the tip 3010 of the container body 301 of the aforementioned powder container. It shows an opening 3012 for supplying to the apparatus the powder stored inside the container body 301, an engagement member 302 for forming an integral structure by locking and linking the engagement member 302 to the container body 301, and a locking member 303 for locking and linking the engagement member 302 to the container body 301. The engagement member 302 shown in FIGS. 16 and 17 represents only the portion where the locking member 303 in the engagement member 302 of FIG. 15 is mounted.

As shown in FIG. 16, the toroidal engagement member 302 is inserted into the cylindrical tip 3010 of the container body 301 of the powder container in the present invention, and is engaged therewith. The engagement member 302 is fitted and engaged with the locking member holding means 3021 in the locking member holding unit 3020 on the engagement member 302, whereby the engagement member 302 is integrally engaged with the container body 301.

Figure 17:
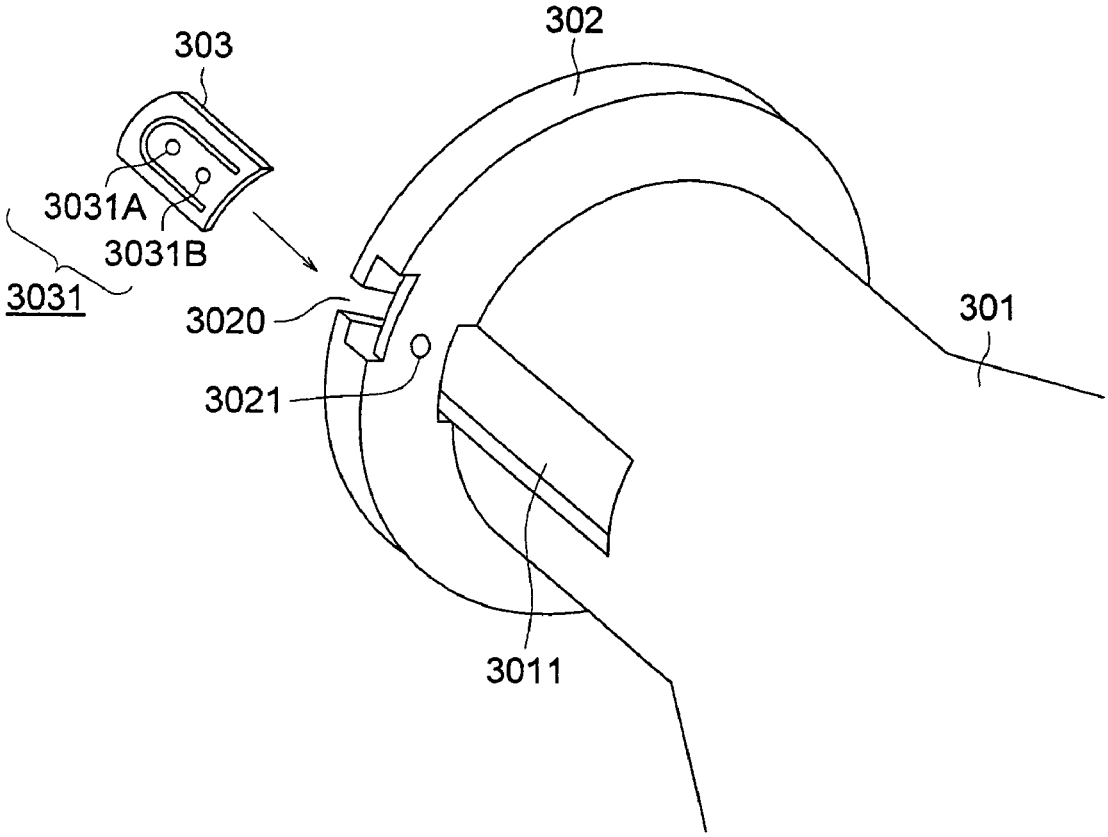
FIG. 17 is a perspective view around the tip of the container body of the powder container as viewed from opposite to FIG. 16.

FIG. 17 is a perspective view as viewed from opposite to FIG. 16. It shows how the locking member 303 is used to link the engagement member 302 integrally with the container body 301. As is clear from FIG. 17, the locking member 303 is inserted into the locking member holding unit 3020 of the engagement member 302 for engagement integrally with the container body 301.

As shown in FIGS. 16 and 17, the end of the locking member 303 inserted into the locking member holding unit 3020 is engaged into the flute 3011 provided at the tip 3010 of the container body 301, and the engagement member 302 integral with the container body 301 is supported by the cylindrical tip 3010, using the flute 3011 as a guide rail. After having been made integral with the container body 301, the engagement member 302 is formed in such a way that it can move along the flute 3011 in the arrow marked direction in FIG. 15.

In the powder container in the present invention, the end of the engagement member 303 mounted on the engagement member 302 enters the flute 3011 of the container body 301. This arrangement allows the engagement member 302 to be held on the container body 301 and facilitates the work to be done to the container body 301, where this work is performed when the engagement member 302 is mounted in position. For example, the film-like sealing material is bonded to the opening 3012 of the tip 3010 of the container body, and the sealing material end is laminated around the engagement member 302. This work is done very easily.

Figure 18:
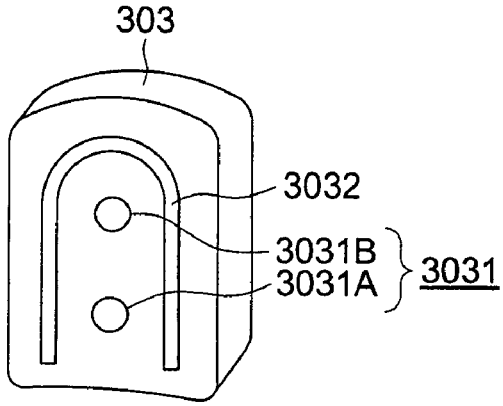
FIGS. 18(*a*) to (*c*) are schematic diagrams representing an example of a locking member according to the present invention and its fitting conditions.
Figure 18:
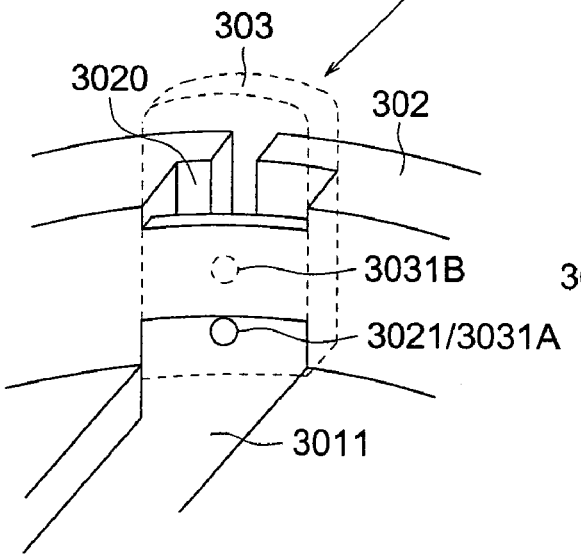
Figure 18:
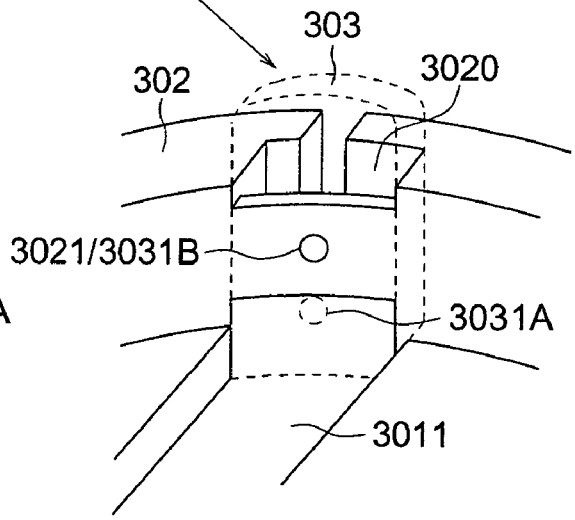

The following describes how to hold the engagement member 302 in the present invention:

FIG. 18 shows the form of the locking member having the shape of a plate as one of the locking members in the present invention and the fitting conditions of this locking member.

As shown in FIG. 18, the locking member 303 in the present invention is plate-formed and has a holding means 3031A and 3031B for holding on the engagement member 302 and a notch 3032 as energizing means for energizing the locking member when mounting the locking member 303 on the engagement member 302.

As shown in FIGS. 18(*a*), and (*b*), when the locking member 303 shown by the broken line is mounted on the engagement member 302, the holding means 3031 of the locking member 303 is inserted into the locking member holding unit 3020 of the engagement member 302 and the holding means 3031 of the locking member 303 is fitted into the locking member holding means 3021 on the side of the engagement member in the energized state. Then the locking member 303 is mounted in position.

The state of holding by the locking member holding means 3021 on the side of the engagement member 302 and holding means 3031 of the locking member 303 are arranged to be maintained if the locking member 303 is not deenergized. Similarly, the state of holding by locking member holding means 3021 of engagement member 302 and the holding means 3031 of the locking member 303 can be maintained if the locking member is not energized, and the structure is so arranged as to permit reuse. If these conditions are met, there is no restriction in particular. To put it more specifically, when the holding means 3031 on the locking member side is a projection, the locking member holding means 3021 on the side of the engagement member 302 is a hole engaged with this projection. Alternatively, when the holding means 3031 is a hole, the projection fitted with this hole is used. Alternatively, rigid fibrous objects such a Velcro fasteners (R) are arranged on both of them, and these fibrous objects are intertwined with each other to form the state of holding.

FIG. 18(*c*) shows the case where two holding means are provided on the locking member, without the present invention being restricted thereto. There is no restriction to its number if holding means are arranged regularly on the locking member surface, the strength of the locking member can be maintained and reuse is not adversely affected. In the locking member 303 in FIG. 18(*c*), when holding means 3031A is fitted to the locking member holding means 3021 on the side of the engagement member as shown in FIG. 18(*a*), this state is assumed as a temporarily locked state, and a film-like sealing material is bonded to the opening 3012. The ends of the sealing materials are connected with each other. Upon completion of this work, the holding means 3031B shown in FIG. 18(*b*) is fitted to the locking member holding means 3021 on the side of the engagement member to reach the finally locked state. The product is now ready for shipment.

In the powder container in the present invention, the engagement member 302 is engaged with the container body 301 through the locking member 303 so that they are made integral with each other. If the locking member 303 is deenergized, the locking member 303 having been rigidly fitted can be easily removed from the locking member holding unit 3020. When the locking member 303 is removed, the engagement member 302 can be easily removed from the container body 301. This allows easy disassembling of the powder container.

As described above, the powder container in the present invention can be easily disassembled. When the used powder container product is reused by recycling, component parts can be washed as they are removed. This makes it possible to completely wash away the old powder to be removed from the component parts. Thus, this arrangement ensures reuse of the container and prevents entry of impurities into powder.

The following describes the resin materials constituting the container in the present invention:

There is no restriction to the resin materials constituting the container in the present invention if they are thermoplastic resins that can be molded. To put it more specifically, they include polypropylene (PP), polyethylene (PE), ABS resin and high impact polystyrene (HIPS). Of these, polypropylene, polyethylene and high impact polystyrene (HIPS) are used in preference.

Injection molding and hollow molding methods can be mentioned to mold the container in the present invention. Resins mentioned above can be used in these methods, but not all resins can be used in any of these methods. Especially when resin is used to manufacture toner container, it is preferred to select the resin whose physical property values such as melt index and whose density are kept within a certain range, in order to ensure that the container will not be damaged by shock during transportation and operation as well as by repeated use.

In injection molding, resin is poured into the gap of dies, and this requires an adequate flow characteristics. It is preferred to use the resin where the melt index value lies within the range from 1 to 30 g/10 min. as in the case of polypropylene and the density stays within the range of 0.94 to 0.97 g/cm$^3$ as in the case of polyethylene. If the melt index is smaller than the value in this range, flow characteristics will deteriorate and uneven filling of resin in the die will occur, with the result that uneven outer thickness of the container wall and insufficient strength will be caused. If the melt index is greater than the value in this range, flow characteristics will be improved and uniform filling of resin in the die will be ensured, but thermal stability and holding characteristics will deteriorate. Either case is not appropriate for a container to be reused.

In hollow molding, resin is poured in the dies and compressed air is blown into the resin with resin sandwiched between dies so that resin will be inflated and brought in close contact with the die surfaces. Then resin is cooled solidified for molding. In this method, good results can be gained by using the resin whose value of melt index is kept within the range from 0.1 to 4 g/10 min. as in the case of polypropylene and whose density lies within the range of 0.94 to 0.97 g/cm$^3$ as in the case of polyethylene. If the melt index is smaller than the value in this range, flow characteristics of the molten resin will deteriorate. So uniform inflation is difficult in the process of inflation with compressed air, uneven outer thickness of the container wall will result, and container stability against shock will deteriorate. Further, if the melt index is greater than the value in this range, flow characteristics will be unstable due to excessive ease in flow, and resin tends to remain especially on the lower end. A difference occurs in thickness between the upper and lower portions of the outer wall of the container, with the result that stability against shock is reduced. Either case is not applicable to the container to be reused.

To prevent the container from being damaged when subjected to impact, the specific Izod impact value is preferred to be within the range from 0.1 to 30. If the Izod impact value is smaller than a value in this range, the container will be easily damaged by impact. So this is not applicable to the container to be reused. If the Izod impact value is above a certain range, the container can withstand the practical impact, i.e. the impact that the container body is assumed to be subjected to in the process of physical distribution in reuse. The problem is solved when the Izod impact value lies within the aforementioned range.

For example, the high-density polyethylene as a resin material preferably used for the container body in the present invention has a density of 0.94 through 0.97 g/cm$^3$. The density is measured according to JIS K 7112. It is simple and convenient to use a pycnometer for this measurement.

To put it more specifically, a cleaned and washed pycnometer is prepared, and its mass is measured accurately. This measurement is assumed as b (g). Then immersion liquid is filled up to the marked line at a temperature of 23±0.1° C., and the mass is measured accurately. This measurement is assumed as e (g). Then the pycnometer was made empty and dried and about 1 to 5 grams of a sample was put therein. The mass of the pycnometer is measured with the sample put inside again, and the mass of the dried pycnometer is subtracted from this measurement to obtain the mass of the sample. This is assumed as a (g). Then immersion liquid is added into the pycnometer with sample placed therein. It is placed in a vacuum desiccator with the sample covered. Pressure is reduced to remove air from the immersion liquid. Immersion liquid is added to the pycnometer up to the marked line at a temperature of 23±0.1° C. with air removed from the immersion liquid. The mass is measured. This measurement is assumed as c (g). The density is obtained from this result according to the following calculation formula:

$$\text{Density } (g/cm^3)=\{(a)/((e-b)-(c-e))\}\times\rho$$

where ρ denotes a specific gravity of immersion liquid at 23° C.

For the physical properties, polypropylene is preferred to have a density of 0.90 to 0.91 g/cm$^3$, for example.

Definition of the Izod impact value and measurement method are given in JIS K 7110, and definition of melt index and measurement method are shown in JIS K 7210. These are the basis for measurement. Polypropylene is measured at 230° C./2.16 kg and polyethylene is measured at 190° C./2.16 kg.

In the present invention the thickness of the outer wall constituting the powder container is not restricted in particular. To maintain durability, this thickness is preferred to be 1.0 mm or more. If the thickness of the outer wall is not even, it will be fragile when shock is applied. An allowance of the thickness of 1.0 mm or less, preferably 0.5 mm or less is preferred. This allowance of thickness shows the difference between the average thickness and minimum thickness. The average thickness refers to the average value of the measured values obtained by random measurement at ten positions except for bent portions. The minimum thickness is the value at the position out of these ten positions where the minimum value is measured.

In the powder container of the present invention, powder stored in a container mounted on an apparatus is replenished or supplied to the apparatus. There is no restriction to the powder to be stored in the container. It can be represented, for example, by various types of powder products including powder paint, starch, edible powder, cosmetics such as toilet powder and lime for drawing lines. This powder container can be preferably used as an electrostatic image development toner container used in electrophotographic image formation.

The following describes the electrostatic image development toner container (hereinafter referred to as "toner container") in the present invention:

Toner filled in the electrostatic image development toner container in the present invention comprises the coloring particles including at least binding agent and coloring agent in addition to other additives to be used as required. The average particle diameter is normally 1 to 30 μm, preferably 2 to 8 μm, in terms of volume mean particle diameter. There is no restriction to the bonding resin constituting the coloring particle. Various resins known in the prior art can be used.

For example, there are styrene resin, acryl resin, styrene/acryl resin and polyester resin. There is no restriction to the coloring agent. The known organic and inorganic pigments are used. To put it more specifically, carbon black and nigrosin are used as black toner. Pigments such as C.I. pigment blue 15: 3, C.I. pigment blue 15, C.I. pigment blue 15: 6, C.I. pigment blue 68, C.I. pigment red 48: 1, C.I. pigment red 122, C.I. pigment red 212, C.I. pigment red 57: 1, C.I. pigment yellow 17; C, C.I. pigment yellow 81, C.I. pigment yellow 154 are preferably used as pigments required for yellow, magenta and cyan toner.

Other additives, for example, include electric charge inhibitor such as salicylic acid derivative and azo metal complex, and fixing improver such as low-molecular polyolefin and carnauba wax.

The following describes the method of reusing the powder contained product in the present invention:

In the powder contained product in the present invention, the parts except for the film-like sealing material bonded to the opening 3012 of the container body can be reused according to the following procedure:

(1) First, used powder containers are collected from users and brought to a manufacturer.

(2) The collected powder containers 301 are disassembled into an engagement member 302 and locking member 303 by the manufacturer. Then component parts are washed according to the commonly known method to remove powder remaining on the component parts.

(3) The washed and dried container body 301 is refilled with powder, and the film-like sealing material is fixed to the opening with the engagement member 302 temporarily connected to the container body using the locking member 303 and holding means 3031A.

(4) After the sealing material has been fixed in position, the engagement member 302 is finally connected to the container body 301 by the holding means 3031 of the locking member 303. Then labels are attached to the container body 301 in readiness for shipment.

(5) The powder contained product consisting of a reused powder container is shipped to the market.

(6) Steps (1) through (5) are repeated.

The powder container in the present invention allows easy energization of the locking member 303, and so can be quickly disassembled.

production of parts using the resin having the aforementioned quality without the parts being destroyed by an operator when the container is disassembled easy removal of contaminations from the parts surface quick and reliable cleaning work In the present invention, the result of evaluation tests have revealed that the component parts of the container are not damaged at all despite the aforementioned reuse procedures taken for 50 times or more.

[Effects of the Invention-1]

According to the invention described in (1) and (2) as described above, a cylinder thickness t is 0.3 mm$\leqq$t$\leqq$5.0 mm and a cylinder thickness deviation is $\Delta t \leqq 20\%$. This arrangement ensures that the concave spiral flute on the inner periphery of this cylindrical form and convex spiral flute on the outer periphery are not crushed, and drastically improves the transportability of toner inside the toner container, thereby ensuring a smooth supply of toner into the development apparatus even when there is only a small amount of toner in the toner container.

[Effects of the Invention-2]

The invention described in (201) has provides a powder container characterized in that, when multiple projections provided with regularities are arranged at least around the opening of a container, stable hermeticity is maintained during storage period for a long time despite repeated reuse, and easy and reliable separation of a sealing material by mere hand pulling are ensured.

The invention described in (202) has provided a powder container characterized in that, when a separation member for separating the sealing material is arranged, easy and reliable separation can be achieved with almost no load on the sealing material, and reuse of the sealing material is permitted since no load is imposed on the sealing material.

The invention described in (203) through (212) provides a powder container characterized in that, when the layout, shape, height, layout spacing, density, cross section and other conditions of the projections are specified, the effects described in (201) and (202) are obtained; wherein, furthermore, this powder container is reusable since there is no reduction in deposition strength or separability at the contact position between the container body and sealing material, despite repeated sealing of film-like sealing material on the container body.

The invention described in (213) has been made clear that strong bonding property and quick and reliable separation of the sealing material can be ensured when the multiple projections consisting of convex and concave forms are arranged on the contact position between the container body and sealing material and a heat seal surface is formed. Thus, this invention has completely overthrown the conventional concept in the prior art that the heat seal surface should be maximally smooth.

The invention described in (214) provides a powder contained product characterized in that, when powder is stored into a powder container with multiple projections having regularities formed at the position of the container body in contact with the sealing material, the powder filled therein does not leak out of a clearance between the sealing material and container, and is not affected by external environmental conditions. This arrangement ensures the stable powder quality to be maintained for a long time. Furthermore, when the sealing material is separated, it can be separated in an easy and reliable manner by pulling with hand, without being damaged. The invention described in (214) also provides a reusable powder contained product characterized in that, if the used container is collected and recovered for reuse, the deposition strength and separability between the container body and sealing material are not affected.

The invention described in (215) and (216) provides a powder container manufacturing method that ensures the stable powder quality to be maintained for a long time, without the powder filled inside leaking out or being affected by external environmental conditions. This method also allows the sealing material to be separated in an easy and reliable manner by pulling with hand. This invention further provides a reusable powder container manufacturing method characterized in that deposition strength and separability at the contact positions are not affected when the powder contained product with the opening sealed with the film-like sealing material has been reused and bonding of sealing material to the container body has been repeated.

The invention described in (217) and (218) provides a reusable toner container and a toner contained product characterized by stable, long-term separability and hermeticity maintained despite repeated refilling of the used container with electrostatic image development toner and repeated sealing of the opening with film-like sealing material.

The invention described in (219) and (220) provides a reusable toner container manufacturing method characterized in that stable, long-term separability and hermeticity can be maintained despite repeated refilling of the used container with electrostatic image development toner and repeated sealing of the opening with film-like sheet-formed material.

[Effects of the Invention-3]

The invention described in any one of items (301) through (305) provides a reusable powder container comprising of multiple members engaged with each other. This powder container is characterized by easy disassembling.

The invention described in (303) and (304) ensures that the engagement of the engagement member with the container body is made firmer and more rigid by the locking member by a locking member provided with energizing means. Furthermore, when the holding means of the engagement member side consists of a hole, this invention ensures easy removal of the locking member when released by using a ball-point pen placed into this hole.

The invention described in (305) provides an environment friendly powder container characterized in that the components of the powder container made of the same material not only reduce manufacturing costs, but also allow all parts to be recycled as component materials for a new container without being scrapped when the product itself need not be reused as a result of engineering change or others.

The invention described in (306) provides a powder contained product comprising a powder container filled with powder, wherein this powder container consists of multiple reusable and easy-to-disassemble members.

The art described in (307) provides a powder container manufacturing method wherein the engagement member is temporarily locked onto the container body without any special tool or jig, and such separate work as bonding of sealing material to the opening can be performed in an easy and economical manner.

The art described in (308) provides a powder contained product reusing method for simplifying the disassembling and washing work by a manufacturer when a great number of used powder containers have been collected from the market.

The art described in any one of (309) through (312) provides, the electrostatic image development toner container consists of multiple members engaged with each other that can provide an easily dismountable and reusable electrostatic image development toner container, an electrostatic image development toner contained product consisting of this toner storage container filled with toner, a method for manufacturing this container, and a method for reusing the toner contained product.

What is claimed is:

1. A toner container for supplying and/or replenishing toner into a development apparatus provided in an image forming apparatus, by being engaged with a rotation transfer member of the development apparatus and being rotated about a center axis of the toner container integrally with the rotation transfer member;

the toner container comprising:

a cylindrical body having a toner outlet on one end of the cylindrical body, nearby a center axis of the cylindrical body, wherein the cylindrical body has a first portion having a diameter in outer periphery of the cylindrical body smaller than a diameter of a second portion in outer periphery of the cylindrical body;

a convex spiral flute formed on the inner periphery of the cylindrical body; and a concave spiral flute formed on the outer periphery of the cylindrical body, wherein a ratio L/D of length L to diameter D of the cylindrical body is in a range of $\frac{1}{2} \leqq L/D \leqq 10$; a thickness of the cylindrical body t is 0.3 mm$\leqq t \leqq$5.0 mm; and a thickness deviation of the cylindrical body is $\Delta t \leqq 20\%$ and wherein the first portion has the convex spiral flute and distance between the convex spiral flute in the first portion in longitudinal direction for the cylindrical body is narrower than that in the second portion.

2. The toner container of claim 1, wherein the thickness deviation between the convex spiral flute and the concave spiral flute is $\Delta t \leqq 20\%$.

3. The toner container of claim 1, comprising a sealing member capable to slide toward the toner container when supplying and/or replenishing the toner in the toner container.

4. The toner container of claim 1, wherein the toner is supplied and/or replenished to the development apparatus by rotating the toner container.

5. The toner container of claim 1, being made of polypropylene or polyethylene.

6. The toner container of claim 1, storing toner.

7. The toner container of claim 6, wherein the toner has toner particles with shape coefficient from 1.2 to 1.6 in an amount of 65% or more in number size distribution, and variance coefficient of shape coefficient not more than 16%.

8. The toner container of claim 6 wherein the toner has variance coefficient of shape coefficient not more than 16% and number size variance coefficient in number size distribution not more than 27%.

9. A toner replenishing apparatus for replenishing toner contained in a toner container into a development apparatus provided in an image forming apparatus, by engaging one end of the toner container with a rotation transfer member of the development apparatus and rotating the toner container about a center axis of the toner container integrally with the rotation transfer member;

wherein, the toner container comprises:

a cylindrical body having a toner outlet on one end of the cylindrical body, nearby a center axis of the cylindrical body, the cylindrical body including a first portion having a diameter in outer periphery of the cylindrical body smaller than a diameter of a second portion in outer periphery of the cylindrical body;

a convex spiral flute formed on the inner periphery of the cylindrical body; and a concave spiral flute formed on the outer periphery of the cylindrical body, wherein a ratio L/D of length L to diameter D of the cylindrical body is in a range of $\frac{1}{2} \leqq L/D \leqq 10$; a thickness of the cylindrical body t is 0.3 mm$\leqq t \leqq$5.0 mm; and a thickness deviation of the cylindrical body is $\Delta t \leqq 20\%$ and wherein the first portion has the convex spiral flute and distance between the convex spiral flute in the first portion in longitudinal direction for the cylindrical body is narrower than that in the second portion.

10. The toner replenishing apparatus of claim 9, wherein the thickness deviation of the convex spiral flute and the concave spiral flute is $\Delta t \leqq 20\%$.

11. The toner replenishing apparatus of claim 9, comprising a sealing member capable to slide toward the toner container when supplying and/or replenishing the toner in the toner container.

12. The toner container of claim 9, storing toner.

13. The toner container of claim 12, wherein the toner has toner particles with shape coefficient from 1.2 to 1.6 in an amount of 65% or more in number size distribution, and variance coefficient of shape coefficient not more than 16%.

14. The toner container of claim 12, wherein the toner has variance coefficient of the shape coefficient not more than 16% and number size variance coefficient in number size distribution not more than 27%.

15. A toner container for supplying and/or replenishing toner into a development apparatus provided in an image forming apparatus, by being engaged with a rotation transfer member of the development apparatus and being rotated about a center axis of the toner container integrally with the rotation transfer member;

the toner container comprising:

a cylindrical body having a toner outlet on one end of the cylindrical body, nearby a center axis of the cylindrical body;

a convex spiral flute formed on the inner periphery of the cylindrical body;

a concave spiral flute formed on the outer periphery of the cylindrical body; and a sealing member capable to slide toward the toner container when supplying and/or replenishing the toner in the toner container, wherein a ratio L/D of length L to diameter D of the cylindrical body is in a range of $\frac{1}{2} \leqq L/D \leqq 10$; a thickness of the cylindrical body t is 0.3 mm$\leqq t \leqq$5.0 mm; and a thickness deviation of the cylindrical body is $\Delta t \leqq 20\%$.

16. The toner container of claim 15, wherein the thickness deviation between the convex spiral flute and the concave spiral flute is $\Delta t \leqq 20\%$.

17. The toner container of claim 15, wherein the toner is supplied and/or replenished to the development apparatus by rotating the toner container.

18. The toner container of claim 15, being made of polypropylene or polyethylene.

19. The toner container of claim 15, storing toner.

20. The toner container of claim 19, wherein the toner has toner particles with shape coefficient from 1.2 to 1.6 in an amount of 65% or more in number size distribution, and variance coefficient of shape coefficient not more than 16%.

21. The toner container of claim 19, wherein the toner has variance coefficient of shape coefficient not more than 16% and number size variance coefficient in number size distribution not more than 27%.

22. A toner container for supplying and/or replenishing toner into a development apparatus provided in an image forming apparatus, by being engaged with a rotation transfer member of the development apparatus and being rotated about a center axis of the toner container integrally with the rotation transfer member;

the toner container comprising:

a cylindrical body having a toner outlet on one end of the cylindrical body, nearby a center axis of the cylindrical body;

a convex spiral flute formed on the inner periphery of the cylindrical body; and a concave spiral flute formed on the outer periphery of the cylindrical body, wherein a ratio L/D of length L to diameter D of the cylindrical body is in a range of $\frac{1}{2} \leqq L/D \leqq 10$; a thickness of the cylindrical body t is 0.3 mm$\leqq t \leqq$5.0 mm; and a thickness deviation between the convex spiral flute and the concave spiral flute is $\Delta t \leqq 20\%$.

23. A toner replenishing apparatus for replenishing toner contained in a toner container into a development apparatus provided in an image forming apparatus, by engaging one end of the toner container with a rotation transfer member of the development apparatus and rotating the toner container about a center axis of the toner container integrally with the rotation transfer member;

wherein, the toner container comprises:

a cylindrical body having a toner outlet on one end of the cylindrical body, nearby a center axis of the cylindrical body;

a convex spiral flute formed on the inner periphery of the cylindrical body;

a concave spiral flute formed on the outer periphery of the cylindrical body; and a sealing member capable to slide toward the toner container when supplying and/or replenishing the toner in the toner container, wherein a ratio L/D of length L to diameter D of the cylindrical body is in a range of $\frac{1}{2} \leqq L/D \leqq 10$; a thickness of the cylindrical body t is 0.3 mm$\leqq t \leqq$5.0 mm; and a thickness deviation of the cylindrical body is $\Delta t \leqq 20\%$.

24. The toner replenishing apparatus of claim 23, wherein the thickness deviation of the convex spiral flute and the concave spiral flute is $\Delta t \leqq 20\%$.

25. The toner container of claim 23, storing toner.

26. The toner container of claim 25, wherein the toner has toner particles with shape coefficient from 1.2 to 1.6 in an amount of 65% or more in number size distribution, and variance coefficient of shape coefficient not more than 16%.

27. The toner container of claim 25, wherein the toner has variance coefficient of the shape coefficient not more than 16% and number size variance coefficient in number size distribution not more than 27%.

* * * * *